US012416153B2

(12) United States Patent
Selzer

(10) Patent No.: US 12,416,153 B2
(45) Date of Patent: Sep. 16, 2025

(54) MULTIFUNCTIONAL DESIGN HOUSING COMPONENTS

(71) Applicant: The AZEK Group LLC, Chicago, IL (US)

(72) Inventor: Christopher Scott Selzer, Dawsonville, GA (US)

(73) Assignee: The AZEK Group LLC, Chicago, IL (US)

( * ) Notice: Subject to any disclaimer, the term of this patent is extended or adjusted under 35 U.S.C. 154(b) by 0 days.

(21) Appl. No.: 17/346,385

(22) Filed: Jun. 14, 2021

(65) Prior Publication Data

US 2021/0388615 A1 Dec. 16, 2021

Related U.S. Application Data

(60) Provisional application No. 63/065,556, filed on Aug. 14, 2020, provisional application No. 63/039,214, filed on Jun. 15, 2020.

(51) Int. Cl.

| | |
|---|---|
| ***E04C 1/39*** | (2006.01) |
| ***E04C 3/04*** | (2006.01) |
| ***E04F 10/02*** | (2006.01) |
| ***E04F 17/08*** | (2006.01) |

(52) U.S. Cl.

CPC ..... *E04C 1/39* (2013.01); *E04C 3/04* (2013.01); *E04F 10/02* (2013.01); *E04F 17/08* (2013.01); *E04C 2003/0404* (2013.01)

(58) Field of Classification Search

CPC ..... E04C 1/39; E04C 2003/0404; E04C 3/04; E04C 2003/0417; E04C 2003/043; E04C 2003/0465; E04C 3/28; E04F 10/02; E04F 17/08; E04F 2019/044; E04F 10/10

USPC ..... 52/287.1, 288.1

See application file for complete search history.

(56) References Cited

U.S. PATENT DOCUMENTS

| | | | | | |
|---|---|---|---|---|---|
| 1,657,549 | A * | 1/1928 | Rezac | E04F 17/08 | 174/99 R |
| 1,938,161 | A * | 12/1933 | Whitacre | E04C 1/39 | 52/375 |
| 2,957,483 | A * | 10/1960 | Dunn | E04F 10/02 | 52/63 |
| 3,793,793 | A * | 2/1974 | Dobbins | E04B 5/48 | 138/117 |
| D269,968 | S * | 8/1983 | Rodriguez Moura | D13/155 | |

(Continued)

*Primary Examiner* — Brian E Glessner
*Assistant Examiner* — Adam G Barlow
(74) *Attorney, Agent, or Firm* — Shook, Hardy & Bacon L.L.P.

(57) ABSTRACT

A multifunctional design housing is disclosed. In some examples, the multifunctional design housing includes an outer case with a back wall, a first side wall, and a second side wall. The back wall includes a first back wall edge and a second back wall edge. The first side wall extends forward from the first back wall edge, and the second side wall extends forward from the second back wall edge. The front wall includes a first side wall front edge and a second side wall front edge. A front opening is formed between the first side wall front edge and the second side wall front edge providing access to an interior volume within the outer case. A conduit control arm with a support element is spaced forward from the back wall and coupled to the outer case by a spacing element.

19 Claims, 24 Drawing Sheets

(56) References Cited

U.S. PATENT DOCUMENTS 4,423,284 A * 12/1983 Kaplan ..... H02G 3/0431 52/287.1
4,800,696 A * 1/1989 Miller ..... E04F 17/08 52/220.1
5,134,250 A * 7/1992 Caveney ..... H02G 3/0418 174/101
5,235,136 A * 8/1993 Santucci ..... H02G 3/0437 174/101
5,942,729 A * 8/1999 Carlson, Jr. ..... H02G 3/0418 174/66
6,084,180 A * 7/2000 DeBartolo, Jr. ..... H02G 3/0418 174/101
6,107,575 A * 8/2000 Miranda ..... H02G 3/0437 174/101
6,279,643 B1 * 8/2001 Shipman ..... G09F 15/0068 52/64
6,305,109 B1 * 10/2001 Lee ..... G02B 6/0091 40/617
6,693,238 B2 * 2/2004 Jadaud ..... H02G 3/0406 174/101
6,835,891 B1 * 12/2004 Herzog ..... H02G 3/0418 174/480
7,034,227 B2 * 4/2006 Fox ..... H02G 3/0418 174/101
7,041,897 B2 * 5/2006 Herzog ..... H02G 3/0418 52/287.1
7,326,863 B2 * 2/2008 Herzog ..... H02G 3/0418 52/287.1
9,255,441 B2 * 2/2016 Shargani ..... E04F 10/0633
9,644,389 B2 * 5/2017 Xie ..... E04H 15/34
9,938,723 B2 * 4/2018 Shargani ..... E04H 15/54
10,103,528 B2 * 10/2018 Lewinski ..... H02G 3/0418
10,914,068 B2 * 2/2021 Shargani ..... E04F 10/0655
2003/0016931 A1 * 1/2003 Ferris ..... G02B 6/4459 385/100
2003/0089515 A1 * 5/2003 Federspiel ..... H02G 3/0437 174/480
2008/0142064 A1 * 6/2008 Maraki ..... E04F 10/02 135/121
2011/0265260 A1 * 11/2011 Darrow ..... E01B 25/22 5/85.1
2015/0308128 A1 * 10/2015 Mullaney ..... E04B 1/388 52/220.1
2017/0037635 A1 * 2/2017 Shargani ..... E04F 10/0633
2019/0242136 A1 * 8/2019 Shargani ..... E04F 10/0637
2021/0388615 A1 * 12/2021 Selzer ..... E04C 3/04

* cited by examiner

MULTIFUNCTIONAL DESIGN HOUSING COMPONENTS

CROSS-REFERENCE TO RELATED APPLICATIONS

This application claims priority to U.S. Provisional Application No. 63/039,214, filed Jun. 15, 2020, and to U.S. Provisional Application No. 63/065,556, filed Aug. 14, 2020, each of which the entire contents are incorporated herein by reference.

FIELD OF THE INVENTION

The disclosure relates generally to building materials and, more particularly, to building components for outdoor structures.

BACKGROUND

Outdoor structures such as pergolas and gazebos provide an area for the enjoyment of an outdoor space. These outdoor structures can be made of wood and include vertical posts that support cross beams. The outdoor structures may be used to provide full or partial shade from the sun or rain protection, thereby allowing for a more enjoyable outdoor experience, such as for dining or recreation purposes.

SUMMARY

In some embodiments, a multifunctional design housing includes an outer case including a back wall, a first side wall extending forward from a first back wall edge and a second side wall extending forward from a second back wall edge. The multifunctional design housing further includes a front opening between a first side wall front edge and a second side wall front edge, where the front opening provides access to an interior volume within the outer case. The multifunctional design housing also includes a conduit control arm, where the conduit control arm includes a support element spaced forward from the back wall and coupled to the outer case by a spacing element, and where a back surface of the conduit control arm is in contact with the interior volume.

In some embodiments, a multifunctional design housing includes an outer case including a back wall, a first side wall extending forward from a first back wall edge and a second side wall extending forward from a second back wall edge. The multifunctional design housing further includes a first front opening and a second front opening between a first side wall front edge and a second side wall front edge, where the first front opening provides access to a first interior volume within the outer case and the second front opening provides access to a second interior volume within the outer case. The multifunctional design housing also includes a conduit control arm, where the conduit control arm includes a support element spaced forward from the back wall and coupled to the outer case by a spacing element. Further, a back surface of the conduit control arm is in contact with the first interior volume and the second interior volume.

In some embodiments, an ornamental structure includes at least one multifunctional design housing. The multifunctional design housing includes an outer case including a back wall, a first side wall extending forward from a first back wall edge and a second side wall extending forward from a second back wall edge. The multifunctional design housing further includes a front opening between a first side wall front edge and a second side wall front edge, where the front opening provides access to an interior volume within the outer case. The multifunctional design housing also includes a conduit control arm, where the conduit control arm includes a support element spaced forward from the back wall and coupled to the outer case by a spacing element, and where a back surface of the conduit control arm is in contact with the interior volume. The ornamental structure further includes lights disposed with the interior volume, where there is an unobstructed path between the lights and the front opening.

BRIEF DESCRIPTION OF THE DRAWINGS

The features and advantages of the present disclosures will be more fully disclosed in, or rendered obvious by the following detailed descriptions of example embodiments. The detailed descriptions of the example embodiments are to be considered together with the accompanying drawings wherein like numbers refer to like parts and further wherein.

DETAILED DESCRIPTION

Figure 1:
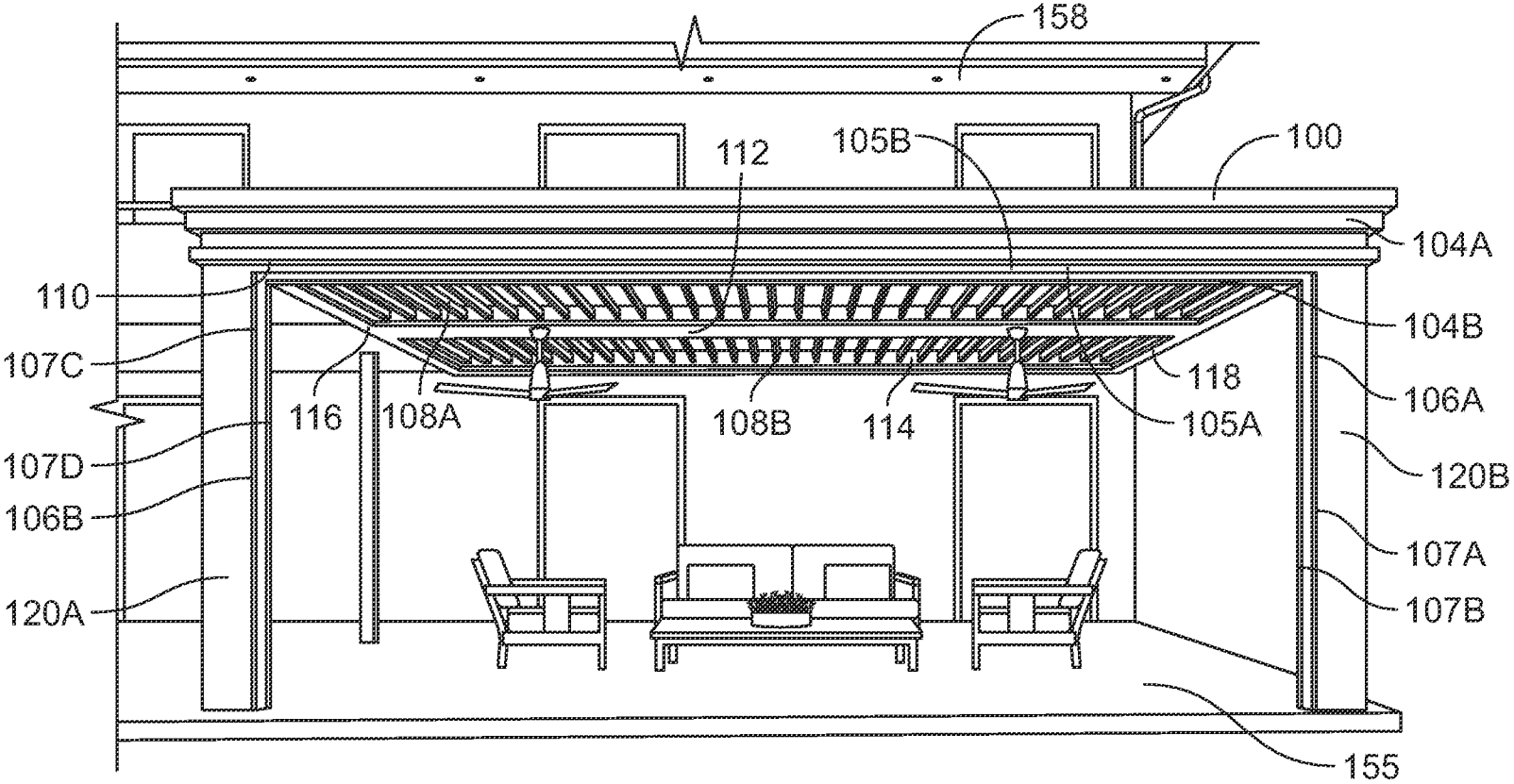
FIG. 1 illustrates an ornamental structure with multifunctional design housing components in accordance with some embodiments.

The description of the preferred embodiments is intended to be read in connection with the accompanying drawings, which are to be considered part of the entire written description of these disclosures. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise, and includes terms such as "directly" coupled, secured, etc. The term "operatively coupled" is such an attachment, coupling, or connection that allows the pertinent structures to operate as intended by virtue of that relationship.

Turning to the drawings, FIG. 1 shows an example ornamental structure 100 located adjacent a house 158. Ornamental structure 100 may be a pergola, for example, that allows for the enjoyment of an outdoor space 155. The ornamental structure 100 can include a front beam 110, a middle beam 112, and a back beam 114 each positioned between a first side beam 116 and a second side beam 118. The ornamental structure 100 further includes a plurality of louvers 108A positioned between front beam 110 and middle beam 112, and a plurality of louvers 108B positioned between middle beam 112 and back beam 114. Ornamental structure 100 also includes a first post 120A and a second post 120B. Each of first post 120A and second post 120B are coupled to front beam 110. For example, each of first post 120A and second post 120B may be secured to front beam 110 with nails, glue, brackets, or any other suitable securing mechanism. Each of front beam 110, middle beam 112, back beam 114, first post 120A and second post 120B may be manufactured out of wood, plastic, plastic composite, metal (e.g., aluminum), or any other suitable material. Louvers 108A, 108B may be manufactured out of wood, plastic, plastic composite, metal (e.g., aluminum), or any other suitable material.

In the example of FIG. 1, a portion of the ornamental structure 100 is supported by the house 158. However, the portion of the ornamental structure 100 supported by the house could also be supported at the corners by additional posts 120C, 120D.

Ornamental structure 100 further includes various multifunctional design housings that can hold components such as wiring and motorized screens. The wiring may provide power to various components including lighting (e.g., LED lighting), and to power electrical devices, such as motorized screens, motorized louvres, ceiling fans, etc. that are attached or used in connection with the ornamental structure 100. In this example, the multifunctional design housings include a first hood track 104A and a second hood track 104B. Each of first hood track 104A and second hood track 104B are secured to front beam 110. For example, the first hood track 104A and the second hood track 104B may be secured to front beam 110 with nails, screws, glues, brackets, or any other suitable securing mechanisms.

Although illustrated as a single first hood track 104A, in some examples, first hood track 104A includes multiple first hood tracks 104A coupled to each other longitudinally to span longer distances. In addition, each of the first hood track 104A and second hood track 104B may include LED strip lighting 105A, 105B, respectively.

Multifunction design housings also include a first column track 106A and a second column track 106B. First column track 106A is secured to second post 120B, and second column track 106B is secured to first post 120A. Although illustrated as a single first column track 106A, in some examples, first column track 106A includes multiple column tracks 106A coupled to each other (e.g., with clips, brackets, or attached to post 120B). Similarly, second column track 106B may be a single second column track 106B or, in some examples, may include multiple second column track 106B coupled to each other.

In addition, first column track 106A includes LED strip lighting 107A, 107B. Similarly, second column track 106B includes LED strip lighting 107C, 107D.

The multifunction design housings, including first hood track 104A, second hood track 104B, first column track 106A, and second column track 106B, may each be manufactured out of wood, plastic, plastic composite, metal (e.g., aluminum), or any other suitable material.

Figure 2A:
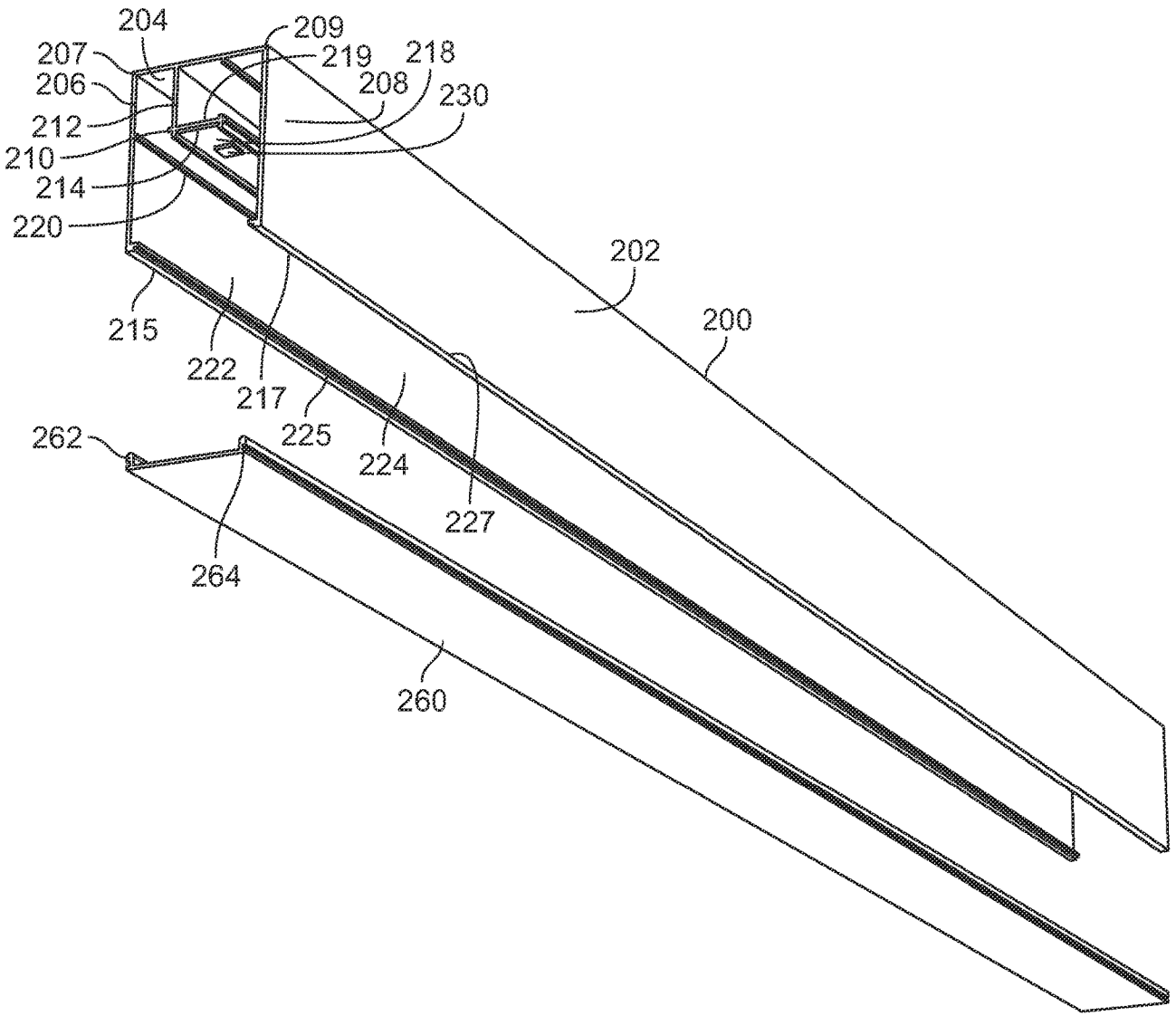
FIG. 2A illustrates a track component of a multifunctional design housing in accordance with some embodiments.
Figure 2B:
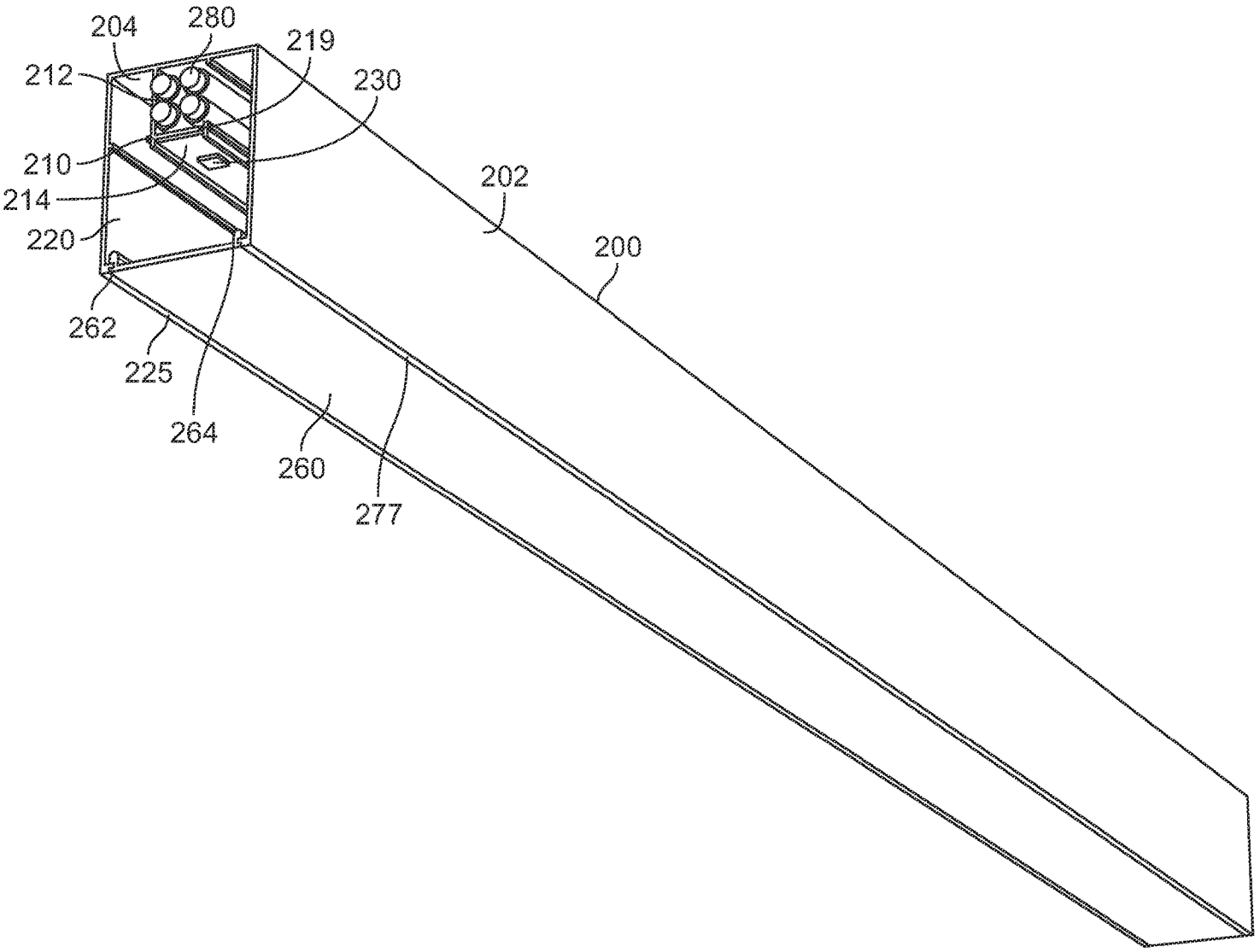
FIG. 2B illustrates another view of the track component of FIG. 2A in accordance with some embodiments.

FIGS. 2A and 2B illustrate a track component 200 that includes an outer case 202 with a back wall 204, a first side wall 206, and a second side wall 208 opposite the first side wall 206. First side wall 206 extends forward from a first back wall edge 207, and second side wall 208 extends forward from a second back wall edge 209. Further, track component 200 includes a front opening 222 between a first side wall front edge 215 and a second side wall front edge 217. The front opening 222 provides access to an interior volume 220 within the outer case 202.

Track component 200 also includes a conduit control arm 210 with a support element 214 spaced forward from the back wall 204 and coupled to the outer case 202 by a spacing element 212, where a front surface 218 of the support element 214 is in contact with the interior volume 220. In some examples, a lateral cross-section of the conduit control arm 210 is generally L-shaped. In some examples, support element 214 includes one or more lights 230, such as light-emitting diodes (LEDs). In some embodiments, the one or more lights 230 can be secured along the front surface 218 of the support element 214.

Spacing element 212 extends from back wall 204, thereby allowing room for components, such as wiring, to be supported by or run along a back surface 219 of the of the support element 214. For example, as illustrated in FIG. 2B, one or more cables 280 may be supported by or run along the back surface 219 of the of the support element 214. In this example, the back surface 219 of the support element 214 is in contact with the interior volume 220.

In some examples, track component 200 includes a uniform lateral cross-section (e.g., from first side wall 206 to second side wall 208 across front opening 222). In some examples, the first back wall edge 207 and the second back wall 209 edge extend longitudinally (e.g., on either side of conduit control arm 210).

In this example, front opening 222 includes an elongated slot 224 defined by a first front opening edge 225 and a second front opening edge 227. In some examples, the support element 214 of the conduit control arm 210 is centered behind the elongated slot 224.

In some examples, track component 200 includes a first front opening covering 260 adapted to be removably coupled to the first and second front opening edges 225, 227. FIG. 2A illustrates first front opening covering 260 removed from the first and second front opening edges 225, 227, while FIG. 2B illustrates first front opening covering 260 coupled to the first and second front opening edges 225, 227. The conduit control arm 210 is spaced apart from the front opening covering 260 when the first front opening covering 260 is removably coupled to the first and second front opening edges 225, 227. To accommodate the coupling, front opening covering 260 may include a first channel 262 and a second channel 264. First channel 262 and second channel 264 are adapted to be removably coupled to the first and second front opening edges 225, 227. For example, each of the first and second front opening edges 225, 227 may "snap" or slide into first channel 262 and second channel 264, respectively, to secure the first front opening covering 260 to outer case 202. In some examples, first front opening covering 260 is translucent or transparent in order to obtain a desired lighting effect.

Track 200 may be employed as a hood track, such as first hood track 104A or second hood track 104B, or as a column track, such as first column track 106A or second column track 106B, of an ornamental structure, such as ornamental structure 100.

Figure 9:
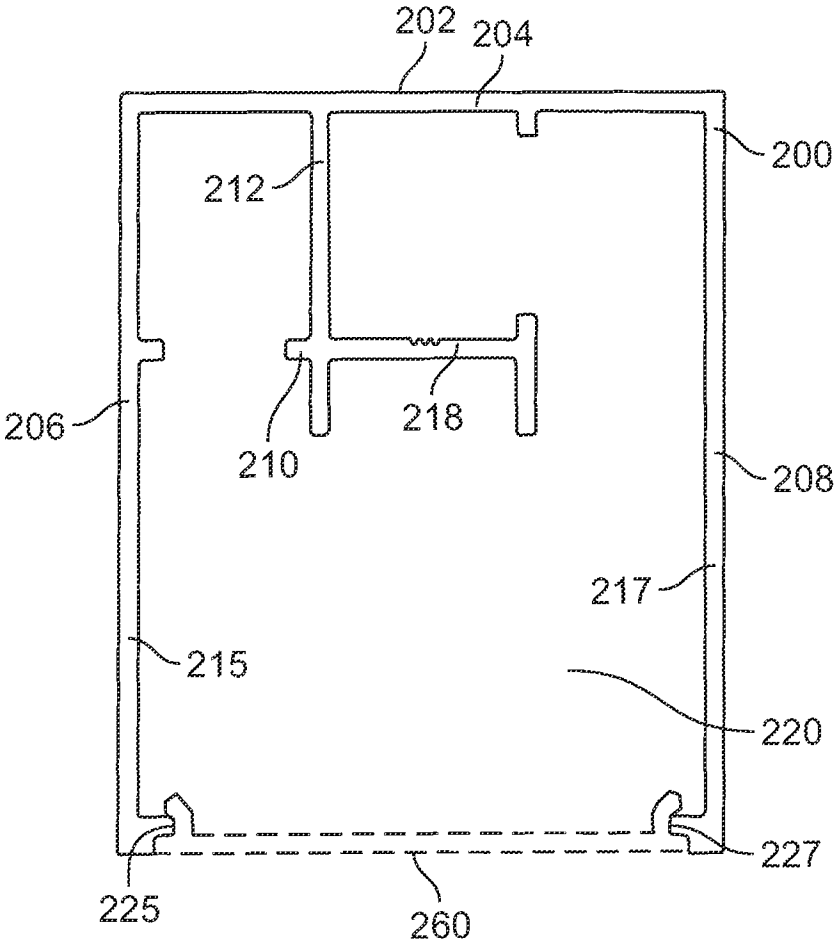
FIG. 9 illustrates a diagram of portions the track component of FIGS. 2A and 2B in accordance with some embodiments.

FIG. 9 illustrates lateral cross-sectional diagram of track component 200. The arrows indicate distances that may be determined prior to manufacturing.

Figure 3A:
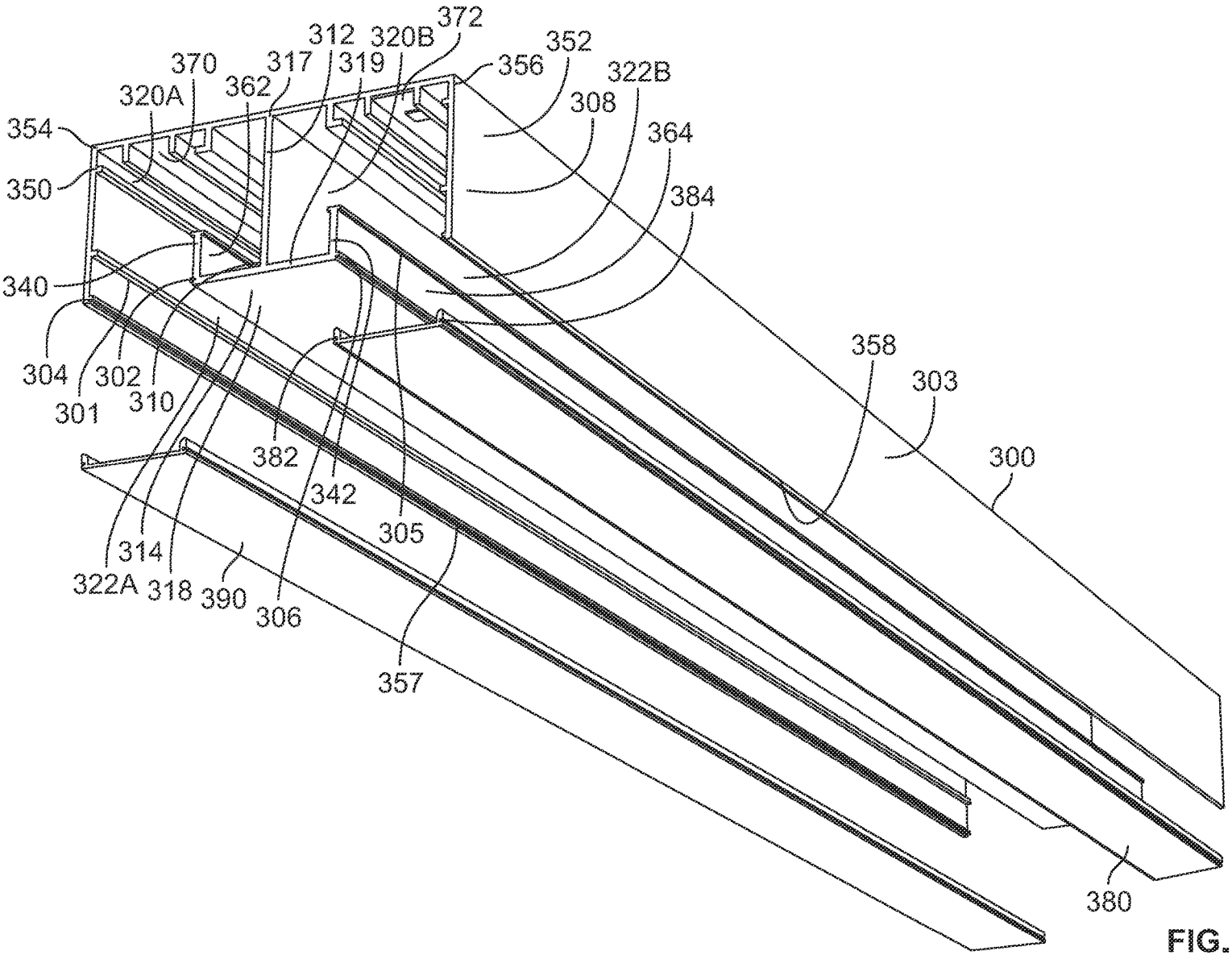
FIG. 3A illustrates a track component of a multifunctional design housing in accordance with some embodiments.
Figure 3B:
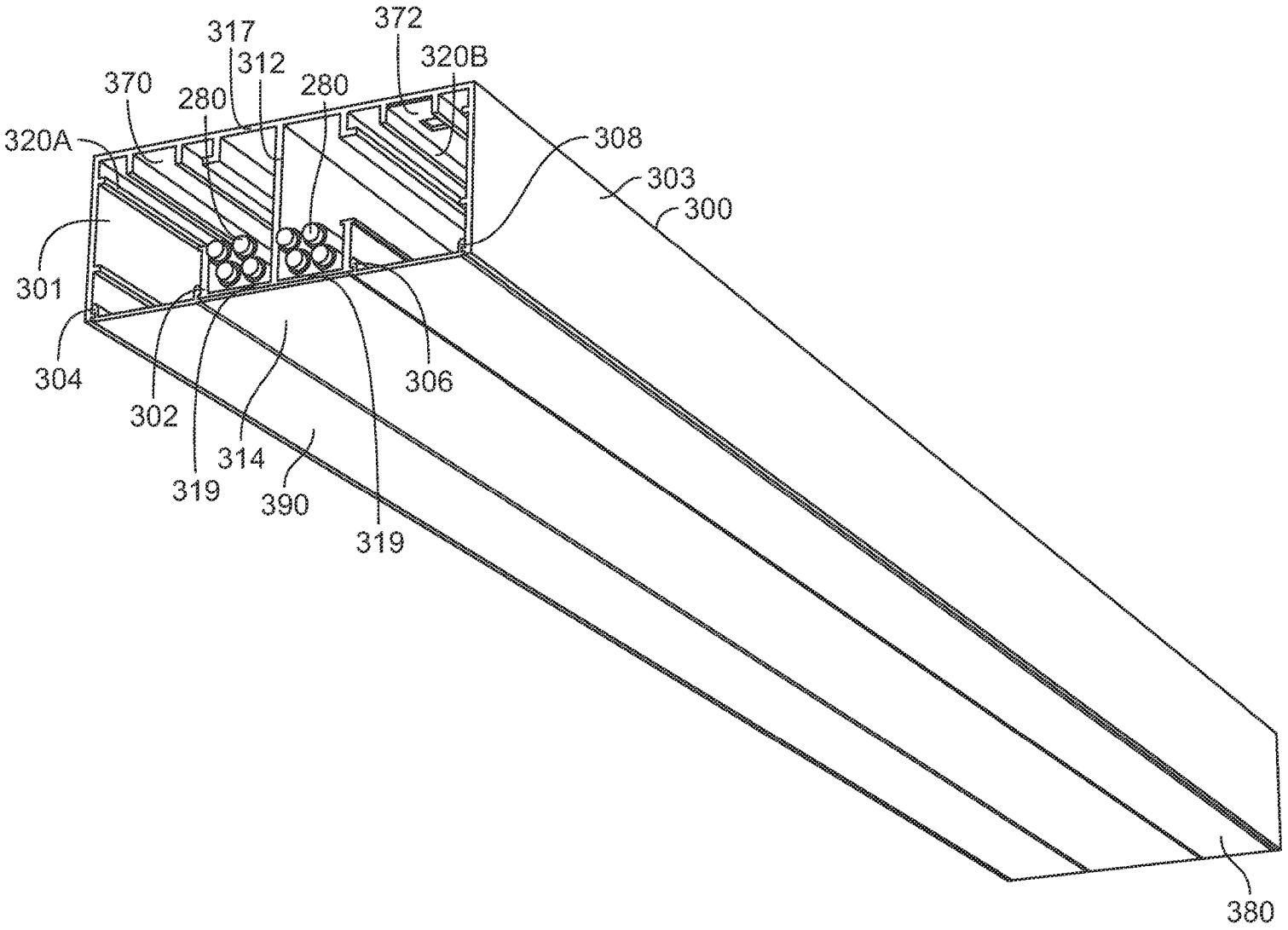
FIG. 3B illustrates another view of the track component of FIG. 3A in accordance with some embodiments.

FIGS. 3A and 3B illustrate a track component 300 includes an outer case 303 with a back wall 317, a first side wall 350, and a second side wall 352 opposite the first side wall 350. First side wall 350 extends forward from a first back wall edge 354, and second side wall 352 extends forward from a second back wall edge 356. Further, track component 300 includes a first front opening 322A and a second front opening 322B between a first side wall front edge 357 and a second side wall front edge 358. The first front opening 322A provides access to a first interior volume 320A within the outer case 303, and the second front opening 322B provides access to a second interior volume 320B within the outer case 303.

Track component 300 also includes a conduit control arm 310 with a support element 314 spaced forward from the back wall 317 and coupled to the outer case 303 by a spacing element 312, where a back surface 319 of the conduit control arm 310 is in contact with the first interior volume 320A and the second interior volume 320B. First interior volume 320A and second interior volume 320B are separated by spacing element 312. In some examples, the first interior volume 320A and the second interior volume 320B include a similar amount of space (e.g., each may include near 50% of their total volume). In some examples, heights of the first side wall 350, the second side wall 352, and the conduit control arm 310 are the same. In this example, a front surface 318 of the conduit control arm 310 is on an exterior of the track component 300.

In some examples, spacing element 314 extends from the back wall 317 of the outer case 303 to an intermediate portion of the support element 314. In some examples, a lateral cross-section of the conduit control arm 310 is generally T-shaped. Support element 314 includes a first support element longitudinal edge 340 and a second support element longitudinal edge 342 opposite the first support element longitudinal edge 340. In some examples, at least one side of the support element 314 includes a conduit retention ridge extending rearwardly. In this example, support element 314 includes a first conduit retention ridge 362 and a second conduit retention ridge 364 each extending rearwardly. As illustrated in FIG. 3B, one or more sets of cables 280 may be supported by or run along a back surface 319 of the support element 314 on either side of spacing element 314.

In this example, first front opening 322A includes a first slot 301 and second front opening 322B includes a second slot 305, each of the first slot 301 and second slot 305 located on opposite sides of the spacing element 314. The first slot 301 is defined by a first slot inner edge 302 and a first slot outer edge 304, and the second slot 305 is defined by a second slot inner edge 306 and a second slot outer edge 308. As illustrated, in some examples the opposing first and second longitudinal edges 340, 342 of the support element 314 include the first slot inner edge 302 and the second slot inner edge 306, respectively. In some examples, the first side wall 350 and the second side wall 352 include the first slot outer edge 304 and the second slot outer edge 308, respectively.

In some examples, the back wall 317 includes at least one channel aligned with either the first slot 301 or the second slot 305. In this example, the back wall 317 includes a first channel 370 aligned with the first slot 301, and a second channel 372 aligned with the second slot 305.

In some examples, track component 300 includes a first slot covering 390 adapted to be removably coupled to the first slot inner edge 302 and the first slot outer edge 304. For example, the first slot covering 390 may be slidably coupled, snapably coupled, or screwed to each of the first slot inner edge 302 and the first slot outer edge 304. In some examples, track component includes a second slot covering 380 adapted to be removably coupled to the second slot inner edge 306 and the second slot outer edge 308. For example, the second slot covering 380 may be slidably coupled, snapably coupled, or screwed to each of the second slot inner edge 306 and the second slot outer edge 308.

In some examples, at least one of the first slot covering 390 and the second slot covering 380 are translucent or transparent. For example, each of the first slot covering 390 and the second slot covering 380 may be translucent or transparent. While FIG. 3A illustrates first slot covering 390 and second slot covering 380 removed the support element 314, FIG. 3B illustrates first slot covering 390 removably coupled to the first slot inner edge 302 and the first slot outer edge 304, and second slot covering 380 removably coupled to the second slot inner edge 306 and the second slot outer edge 308.

Track 300 may be employed as a hood track, such as first hood track 104A or second hood track 104B, or as a column track, such as first column track 106A or second column track 106B, of an ornamental structure, such as ornamental structure 100.

Figure 8A:
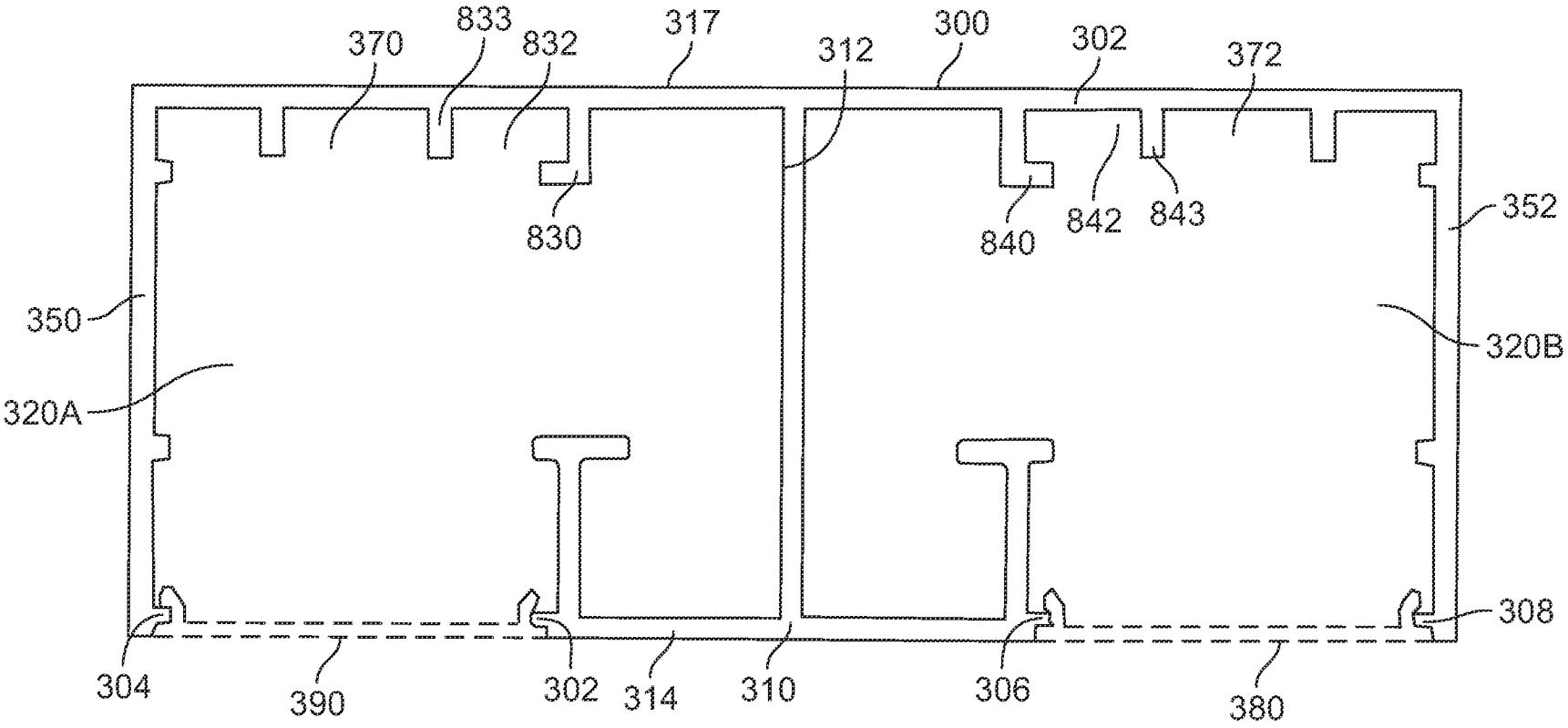
FIG. 8A illustrates a diagram of portions of the track component of FIGS. 3A and 3B in accordance with some embodiments.
Figure 8B:
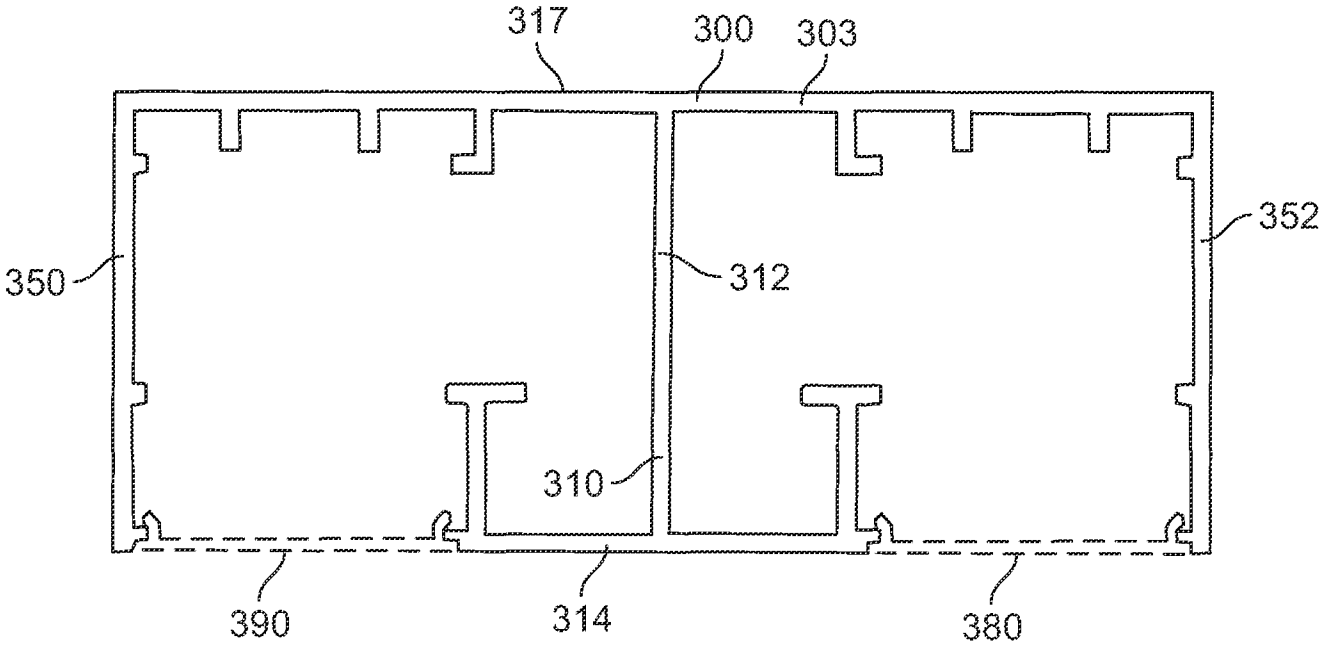
FIG. 8B illustrates another diagram of portions of the track component of FIGS. 3A and 3B in accordance with some embodiments in accordance with some embodiments.

FIGS. 8A and 8B illustrate diagrams of track component 300. Referring to FIG. 8A, track component 300 includes a first back wall channel 832 within first interior volume 320A. First back wall channel 832 is defined by a first back wall channel first wall 833 and a first back wall channel second wall 830. First back wall channel 832 may run longitudinally along first channel 370. Track component 300 also includes a second back wall channel 842 within second interior volume 320B. Second back wall channel 842 is defined by a second back wall channel first wall 843 and a second back wall channel second wall 840. Second back wall channel 842 may run longitudinally along second channel 372. The arrows in FIG. 8B indicate distances that may be determined prior to manufacturing.

Figure 4A:
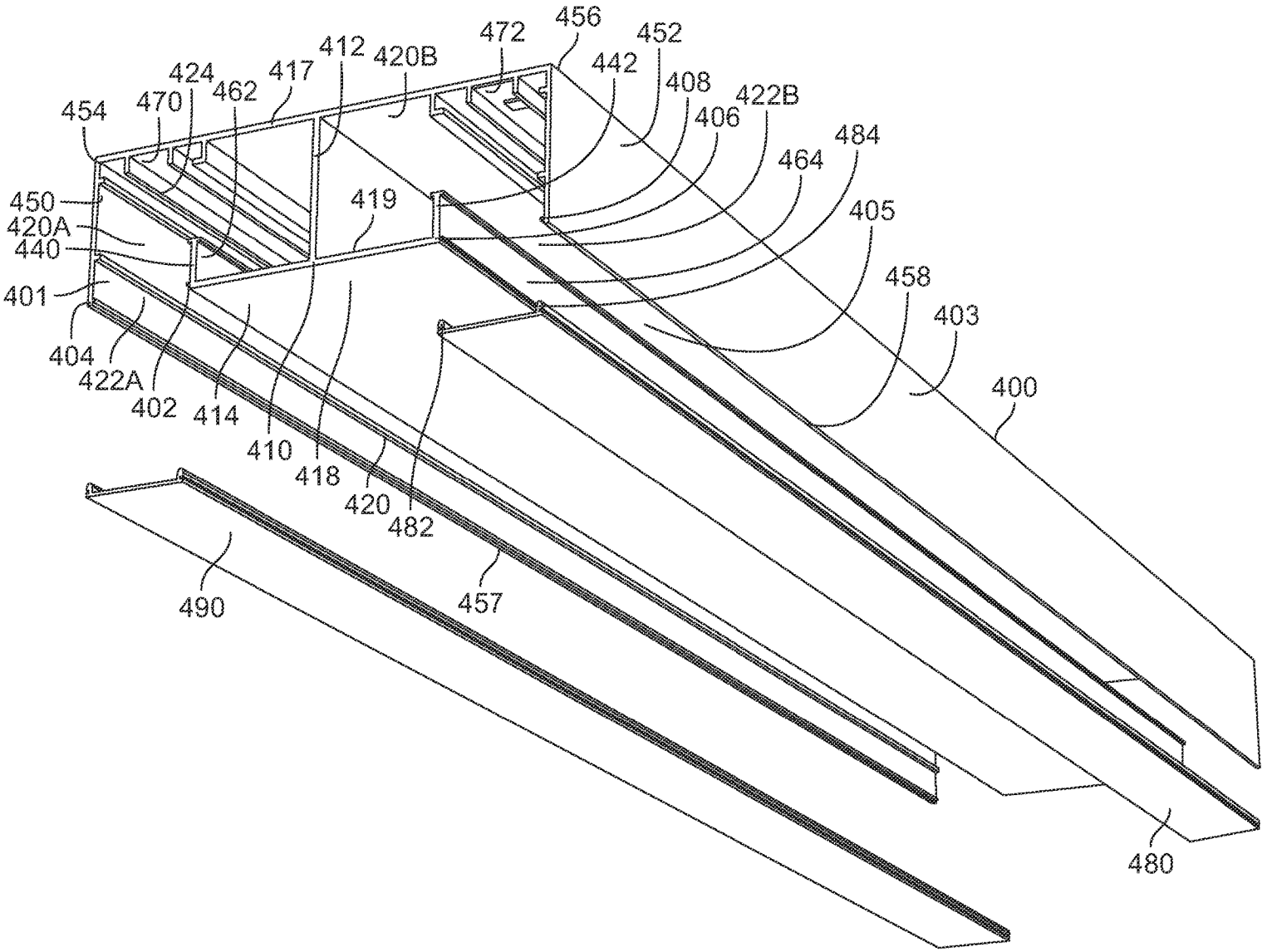
FIG. 4A illustrates a track component of a multifunctional design housing in accordance with some embodiments.
Figure 4B:
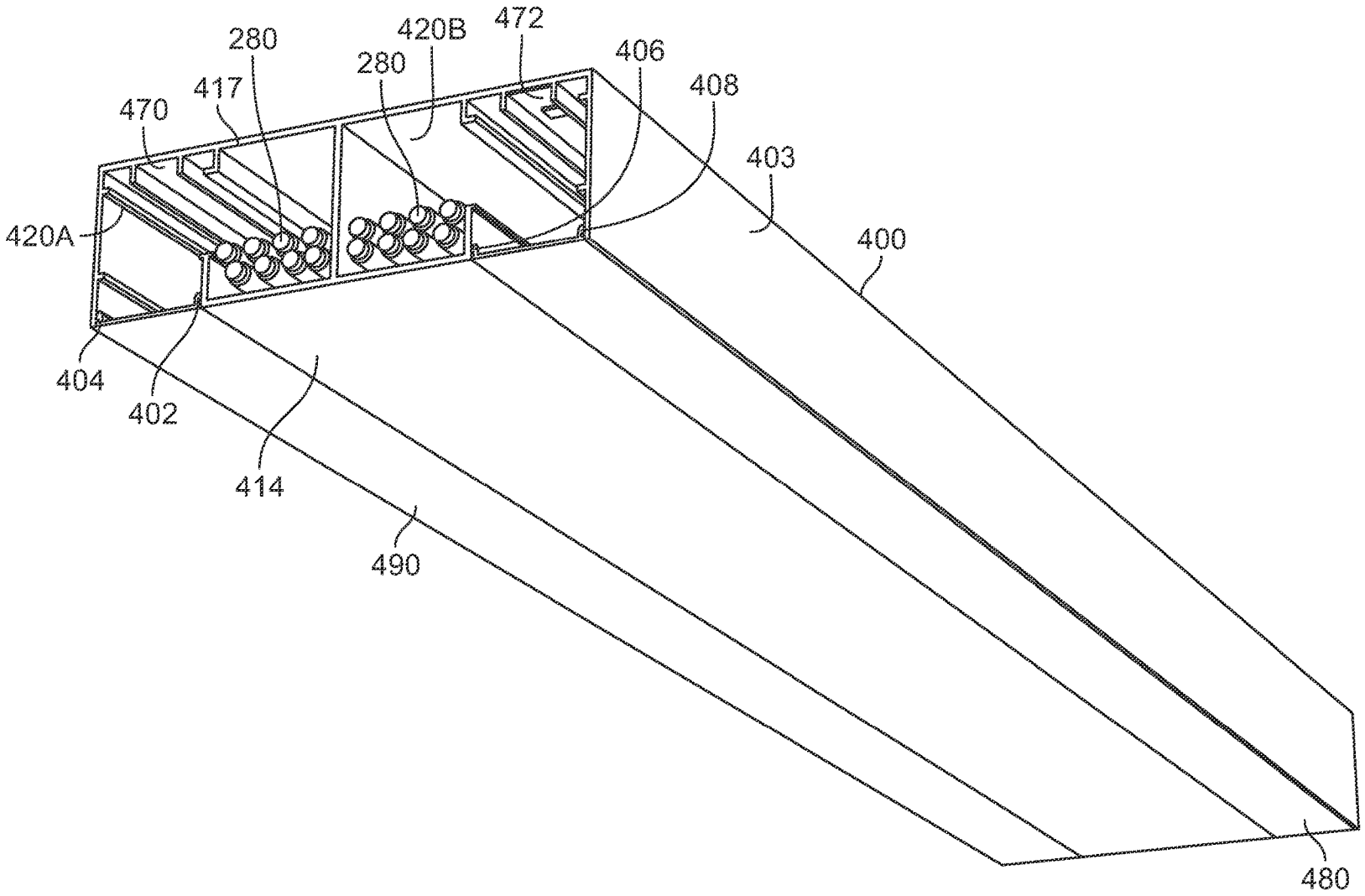
FIG. 4B illustrates another view of the track component of FIG. 4A in accordance with some embodiments.

FIGS. 4A and 4B illustrate a track component 400 that includes an outer case 403 with a back wall 417, a first side wall 450, and a second side wall 452 opposite the first side wall 450. First side wall 450 extends forward from a first back wall edge 454, and second side wall 452 extends forward from a second back wall edge 456. Further, track component 400 includes a first front opening 422A and a second front opening 422B between a first side wall front edge 457 and a second side wall front edge 458. The first front opening 422A provides access to a first interior volume 420A within the outer case 403, and the second front opening 422B provides access to a second interior volume 420B within the outer case 403.

Track component 400 also includes a conduit control arm 410 with a support element 414 spaced forward from the back wall 417 and coupled to the outer case 403 by a spacing element 412, where a back surface 419 of the conduit control arm 410 is in contact with the first interior volume 420A and the second interior volume 420B. First interior volume 420A and the second interior volume 420B are separated by spacing element 412. In some examples, the first interior volume 420A and the second interior volume 420B include a similar amount of space (e.g., each may include near 50% of their total volume). In some examples, heights of the first side wall 450, the second side wall 452, and the conduit control arm 410 are the same. In this example, a front surface 418 of the conduit control arm 410 is on an exterior of the track component 400.

In some examples, spacing element 414 extends from the back wall 417 of the outer case 403 to an intermediate portion of the support element 414. In some examples, the conduit control arm 410 is generally T-shaped. Support element 414 includes a first support element longitudinal edge 440 and a second support element longitudinal edge 442 opposite the first support element longitudinal edge 440. In some examples, at least one side of the support element 414 includes a conduit retention ridge extending rearwardly. In this example, support element 414 includes a first conduit retention ridge 462 and a second conduit retention ridge 464 each extending rearwardly. As illustrated in FIG. 4B, one or more sets of cables 280 may be run along a back surface 419 of the support element 414 on either side of spacing element 414.

In this example, first front opening 422A includes a first slot 401 and second front opening 422B includes a second slot 405, each of the first slot 401 and second slot 405 located on opposite sides of the spacing element 414. The first slot 401 is defined by a first slot inner edge 402 and a first slot outer edge 404, and the second slot 405 is defined by a second slot inner edge 406 and a second slot outer edge 408. As illustrated, in some examples the opposing first and second longitudinal edges 440, 442 of the support element 414 include the first slot inner edge 402 and the second slot inner edge 406, respectively. In some examples, the first side wall 450 and the second side wall 452 include the first slot outer edge 404 and the second slot outer edge 408, respectively.

In some examples, the back wall 417 includes at least one channel aligned with either the first slot 401 or the second slot 405. In this example, the back wall 417 includes a first channel 470 aligned with the first slot 401, and a second channel 472 aligned with the second slot 405.

In some examples, track component 400 includes a first slot covering 490 adapted to be removably coupled to the first slot inner edge 402 and the first slot outer edge 404. For example, the first slot covering 490 may be slidably coupled, snapably coupled, or screwed to each of the first slot inner edge 402 and the first slot outer edge 404. In some examples, track component includes a second slot covering 480 adapted to be removably coupled to the second slot inner edge 406 and the second slot outer edge 408. For example, the second slot covering 480 may include a first edge channel 482 and a second edge channel 484 that can be slidably coupled, snapably coupled, or screwed to each of the second slot inner edge 406 and the second slot outer edge 408, respectively.

In some examples, at least one of the first slot covering 490 and the second slot covering 480 are translucent or transparent. For example, each of the first slot covering 490 and the second slot covering 480 may be translucent or transparent. While FIG. 4A illustrates first slot covering 490 and second slot covering 480 removed the support element 414, FIG. 4B illustrates first slot covering 490 removably coupled to the first slot inner edge 402 and the first slot outer edge 404, and second slot covering 480 removably coupled to the second slot inner edge 406 and the second slot outer edge 408.

Track 400 may be employed as a hood track, such as first hood track 104A or second hood track 104B, or as a column track, such as first column track 106A or second column track 106B, of an ornamental structure, such as ornamental structure 100. Track component 400

Figure 6A:
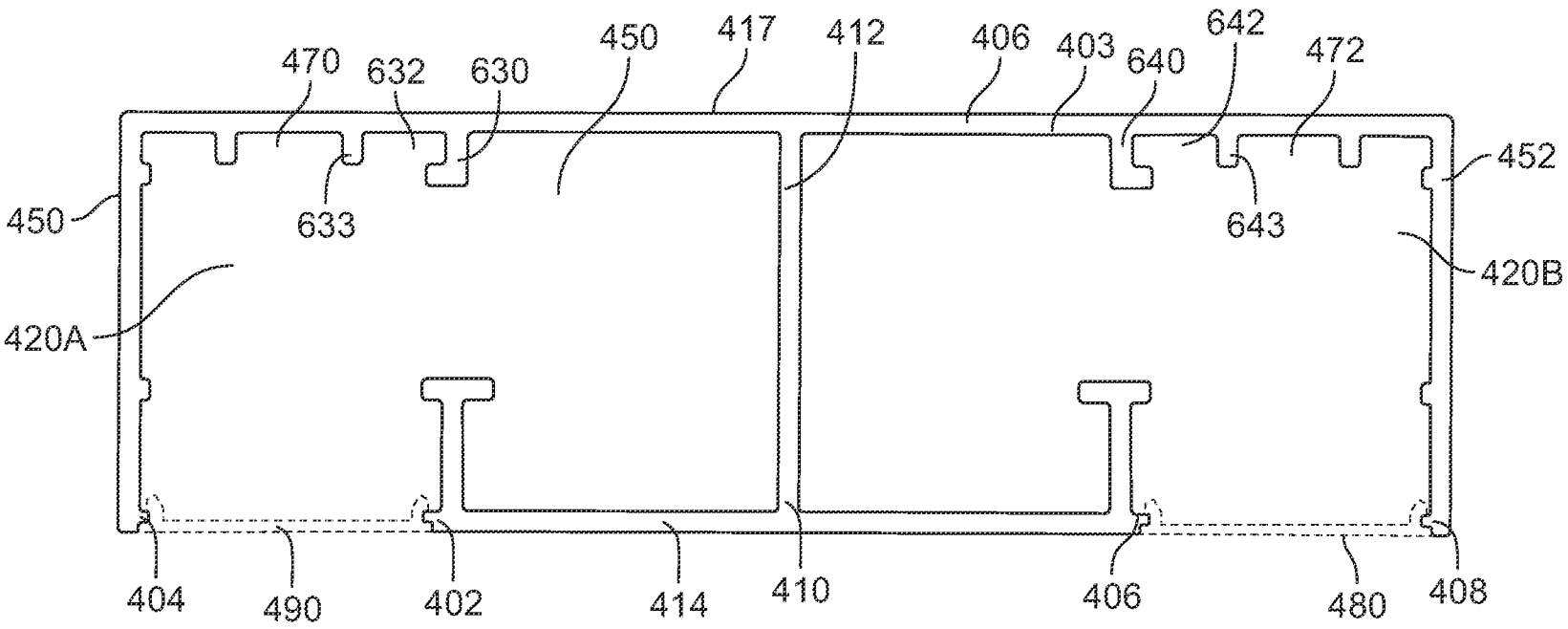
FIG. 6A illustrates a diagram of portions of the track component of FIGS. 4A and 4B in accordance with some embodiments.
Figure 6B:
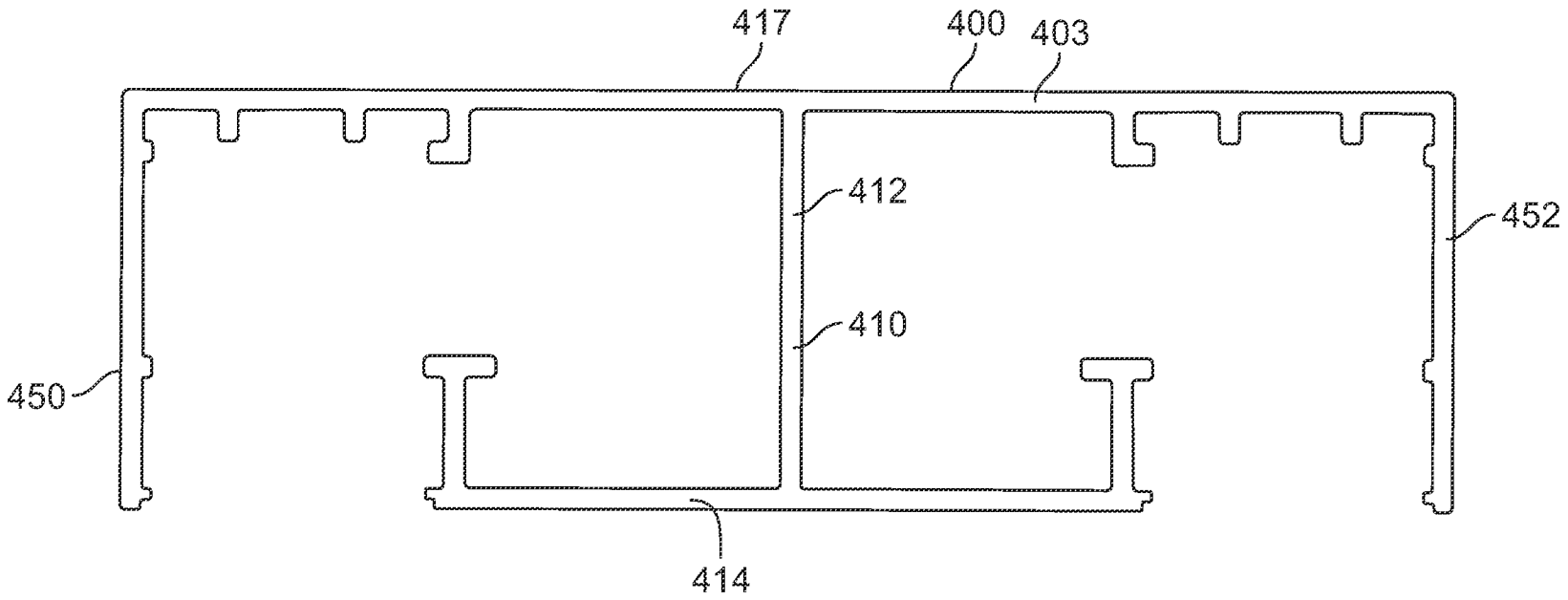
FIG. 6B illustrates another diagram of portions of the track component of FIGS. 4A and 4B in accordance with some embodiments.

FIGS. 6A and 6B illustrate diagrams of track component 400. Referring to FIG. 6A, track component 400 includes a first back wall channel 632 within first interior volume 420A. First back wall channel 632 is defined by a first back wall channel first wall 633 and a first back wall channel second wall 630. First back wall channel 632 may run longitudinally along first channel 470. Track component 400 also includes a second back wall channel 642 within second interior volume 420B. Second back wall channel 642 is defined by a second back wall channel first wall 643 and a second back wall channel second wall 640. Second back wall channel 642 may run longitudinally along second channel 472. The arrows in FIG. 9B indicate distances that may be determined prior to manufacturing.

Figure 5A:
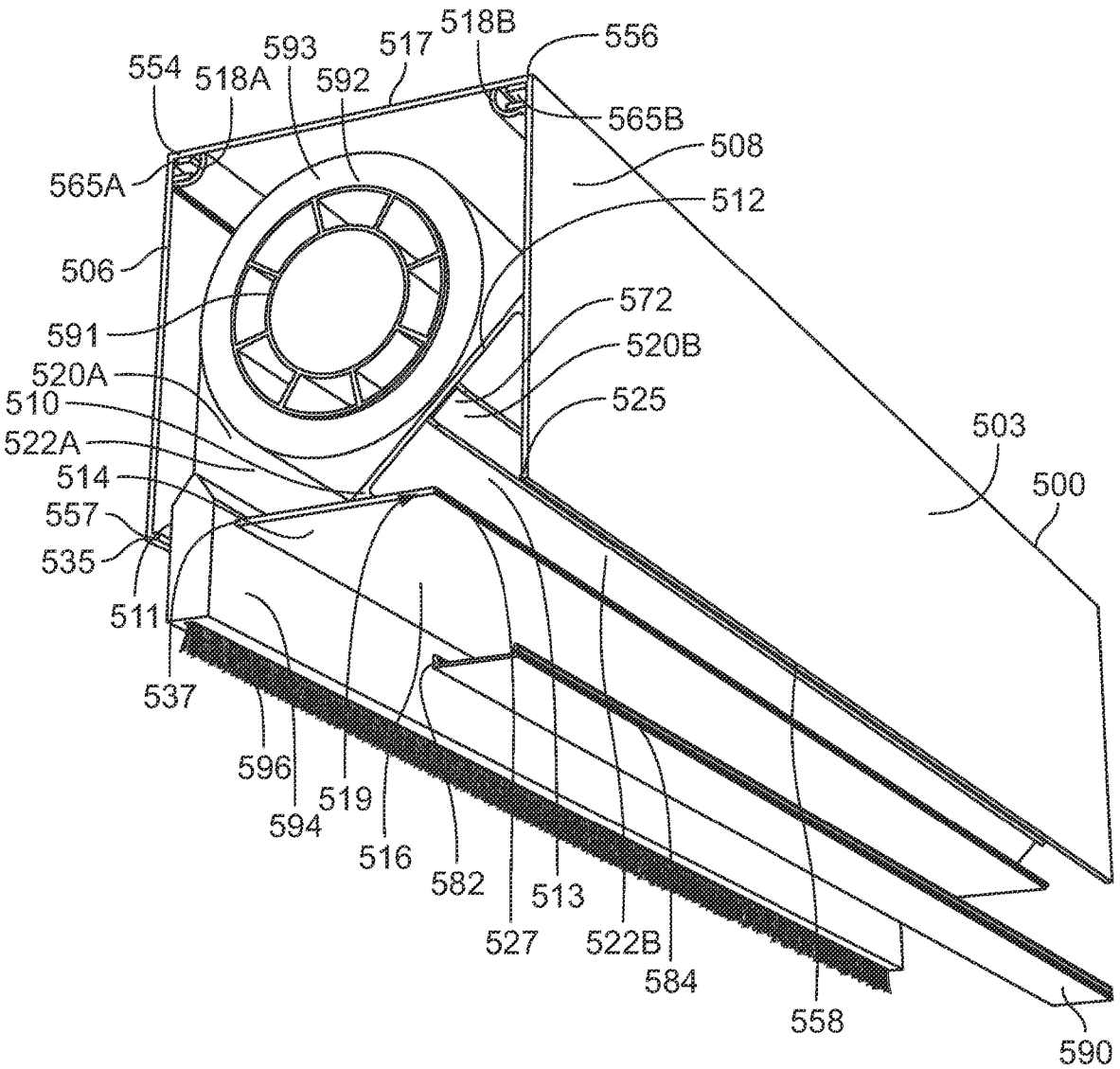
FIG. 5A illustrates a track component of a multifunctional design housing in accordance with some embodiments.
Figure 5B:
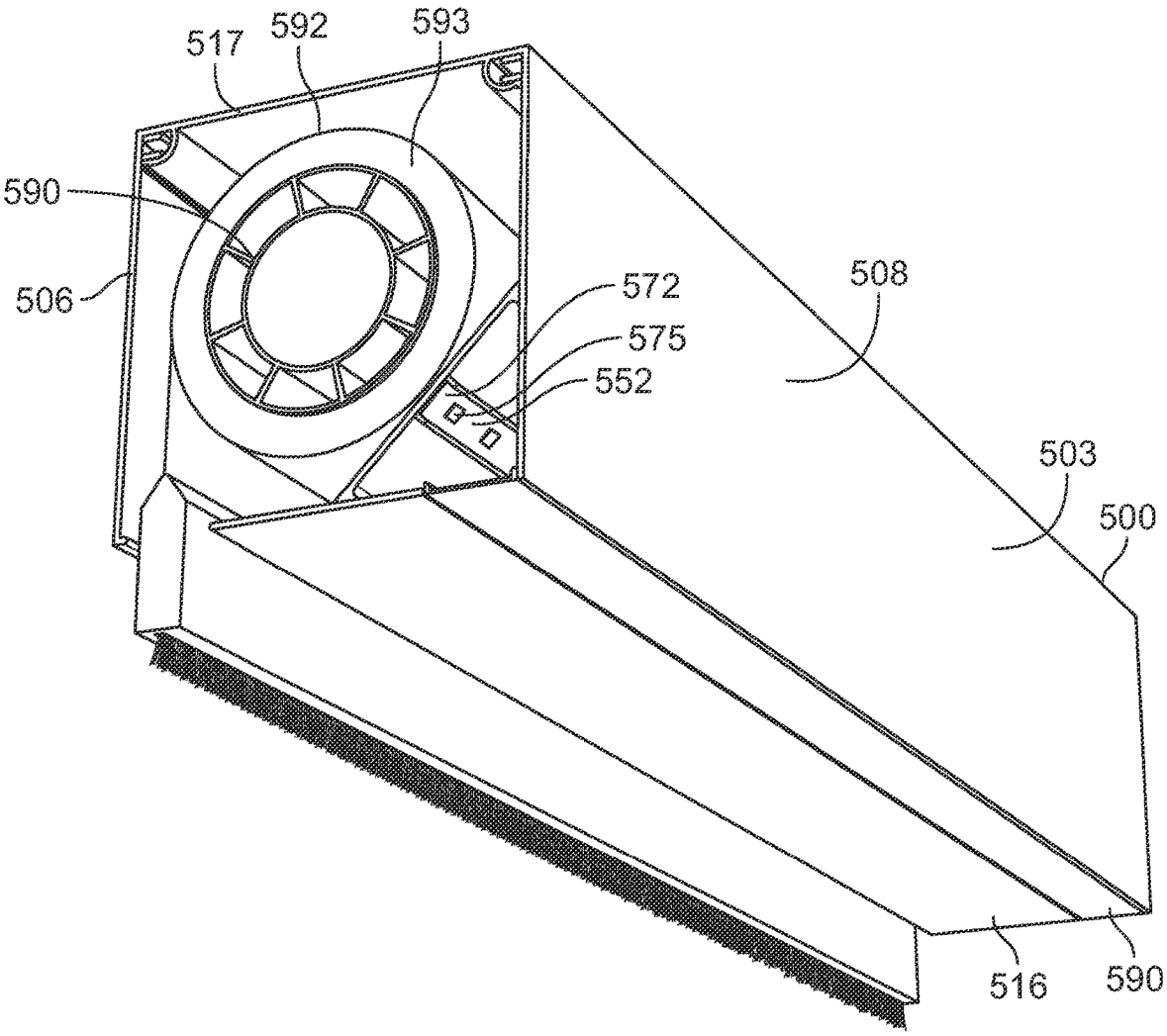
FIG. 5B illustrates another view of the track component of FIG. 5A in accordance with some embodiments.
Figure 5C:
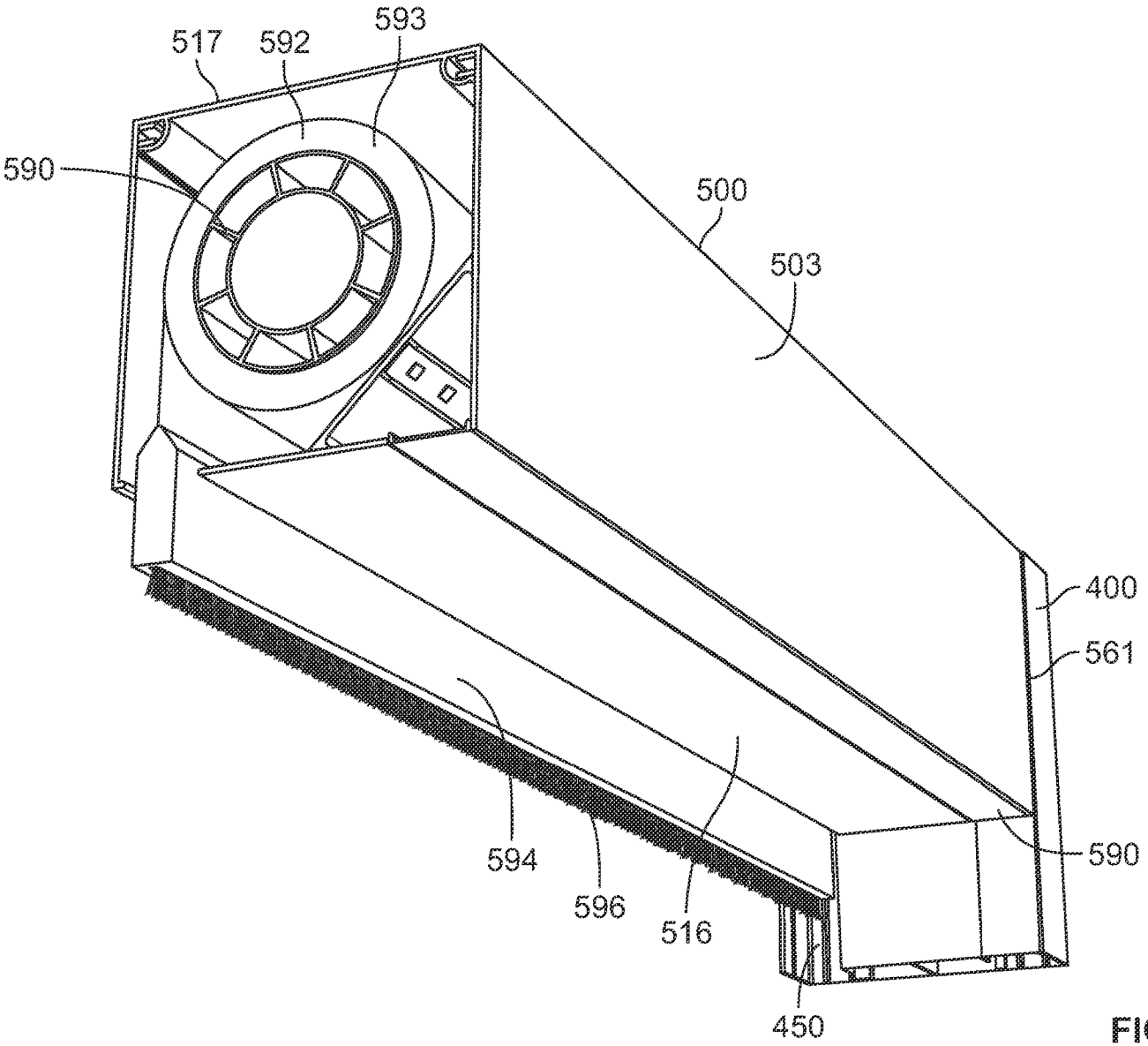
FIG. 5C illustrates the track component of FIG. 5A coupled to another track component in accordance with some embodiments.

FIGS. 5A, 5B, and 5C illustrate a hood component 500 that may be employed as a hood track, such as first hood track 104A or second hood track 104B, of an ornamental structure, such as ornamental structure 100. Hood component 500 includes an outer case 503 with a back wall 517, a first side wall 506, and a second side wall 508 opposite the first side wall 506. First side wall 506 extends forward from a first back wall edge 554, and second side wall 508 extends forward from a second back wall edge 556. First side wall 506 includes a first end tab 565A, and second side wall 508 includes a second end tab 565B. First end tab 565A and second end tab 565B may extend longitudinally along the length of first side wall 506 and second side wall 508, respectively. First end tab 565A can be slidably coupled, snapably coupled, or suitable coupled to a first back wall channel 518A. Similarly, second end tab 565B can be slidably coupled, snapably coupled, or otherwise suitably coupled to a second back wall channel 518B. In some examples, there is a friction fit between first end tab 565A and first back wall channel 518A, and between second end tab 565B and second back wall channel 518B.

Further, track component 500 includes a first front opening 522A and a second front opening 522B between a first side wall front edge 557 and a second side wall front edge 558. The first front opening 522A provides access to a first interior volume 520A within the outer case 503 and the second front opening 522B provides access to a second interior volume 520B. Track component 500 also includes a conduit control arm 510 with a spacing element 512 that extends from the second side wall 508 to an intermediate portion of a support element 514. A back surface 519 of the conduit control arm 510 is in contact with each of the first interior volume 520A and the second interior volume 520B.

First interior volume 520A and second interior volume 520B are separated by spacing element 512. In some examples, a space of the second interior volume 520B is less than 40% of the space of the total of the first interior volume 520A and the second interior volume 520B. In some examples, maximum distances from the back wall 517 to an end of the first side wall 506, an end of the second side wall 508, and the support element 514 are the same. In some examples, a front surface 516 of the conduit control arm 510 is on an exterior of the track component 500. A space element channel 572 extends along a surface of the space element 512 and is in contact with the second interior volume 520B.

First front opening 522A includes a first slot 511 and second front opening 522B includes a second slot 513, each of first front opening 522A and second front opening 522B located on opposite sides of the spacing element 512. The first slot 511 is defined by a first slot inner edge 537 and a first slot outer edge 535, and the second slot 513 is defined by a second slot inner edge 527 and a second slot outer edge 525.

In some examples, hood component 500 includes a slot covering 590 adapted to be removably coupled to second slot inner edge 527 and second slot outer edge 525. For example, the slot covering 590 may include a first edge channel 582 and a second edge channel 584 that can be slidably coupled, snapably coupled, or screwed to each of the second slot inner edge 527 and the second slot outer edge 525, respectively. While FIG. 5A illustrates slot covering 590 removed the support element 514, FIG. 5B illustrates slot covering 590 removably coupled to the second slot inner edge 527 and the second slot outer edge 525.

Hood component 500 further includes a screen roll 591 that may extend through the length of the first interior volume 520A of one or more hood components 500. In this example, the screen roll 591 is part of a retractable screen assembly 592 that includes a retractable screen 593, a weighting member 594 to assist during the lowering of the retractable screen 593, and bristles 596 that may contact the ground when the retractable screen 593 is lowered. The screen roll 591 may be electrically rotated to lower, or raise, the retractable screen 593. In some examples, retractable screen assembly 592 includes a guide rod that extends through first front opening 522A. For example, the guide rod may support and allow the screen roll to rotate. The guide rod may extend through front openings of other components, such as through first front openings 522A of other hood components 500.

FIG. 5C illustrates hood component 500 coupled to a track component 400 along interface plane 561. Hood component 500 may be secured to the track component 300, 400 with nails, screws, glue, brackets, via soldering, or any other suitable securing mechanism. In some examples, hood component 500 may be attached to adjacent portions of ornamental structure 100. In this example, retractable screen 593 can raise and lower through first interior volume 420A of track component 400. As such, in this example, track component 400 does not include first slot covering 490.

Figure 10A:
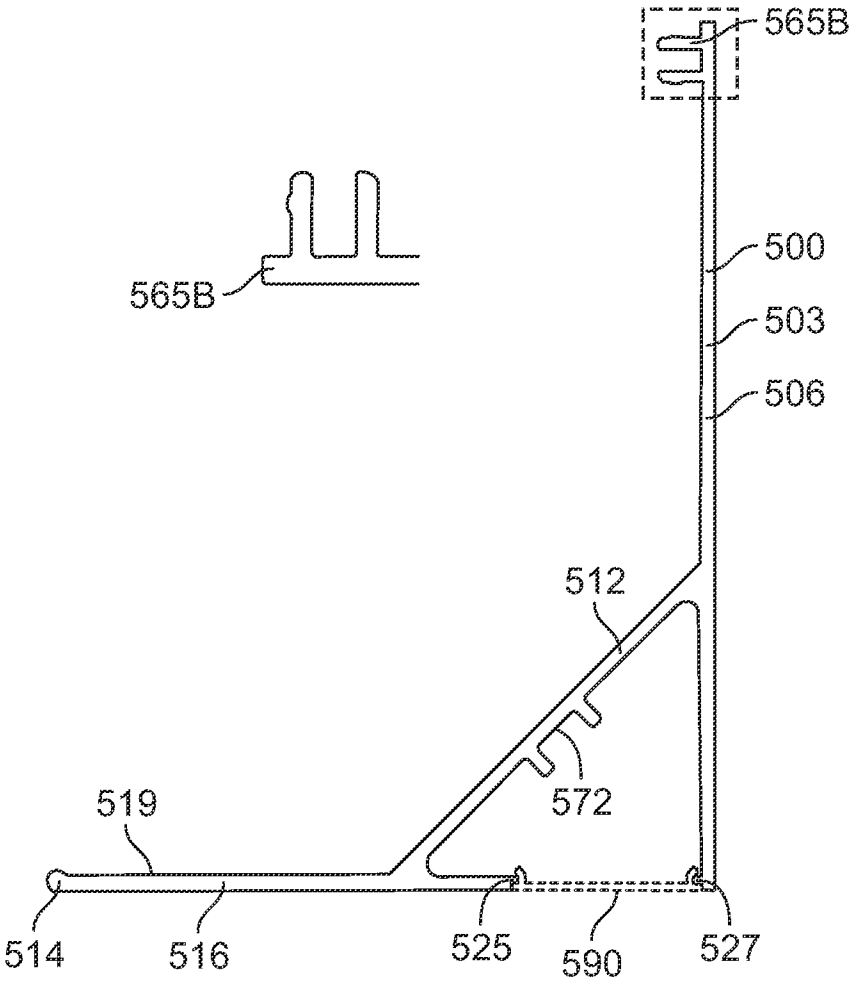
FIG. 10A illustrates a diagram of portions the track component of FIGS. 5A, 5B, and 5C in accordance with some embodiments.
Figure 10B:
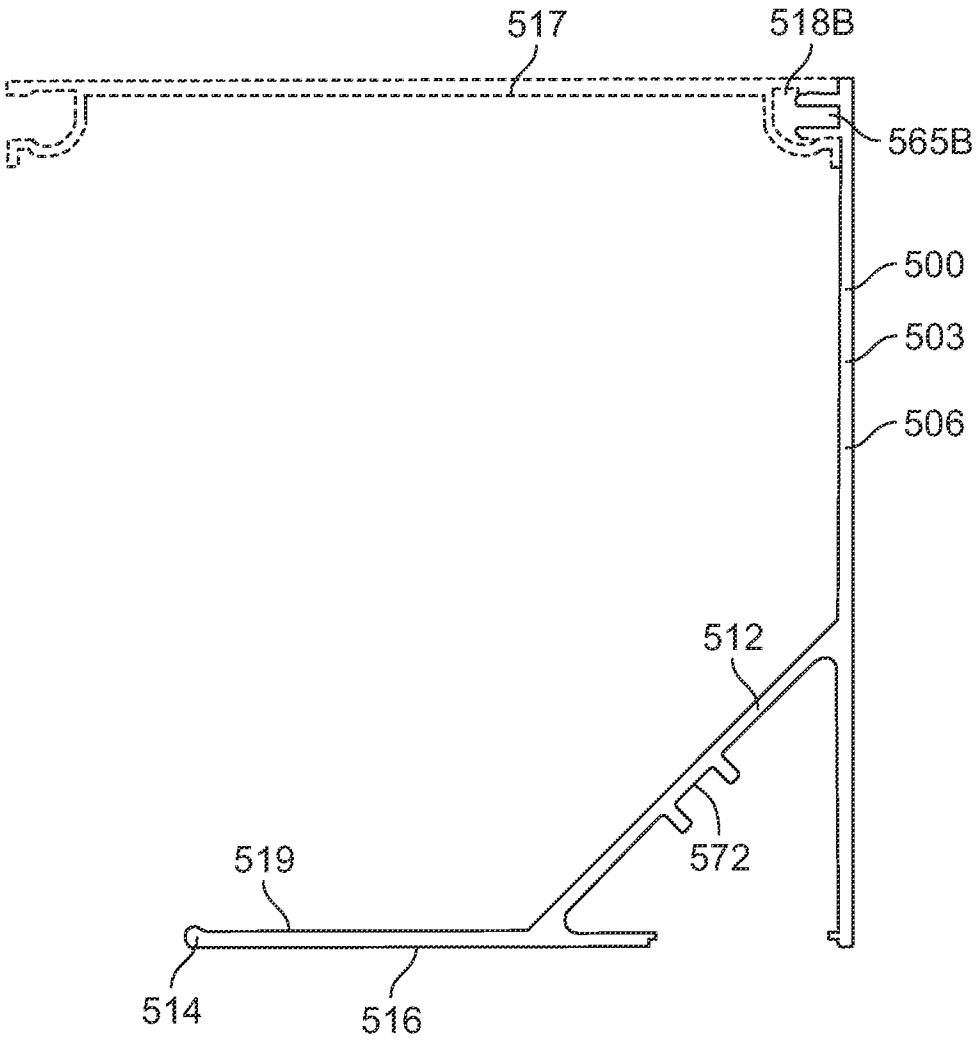
FIG. 10B illustrates another diagram of portions of the track component of FIGS. 5A, 5B, and 5C in accordance with some embodiments.
Figure 10C:
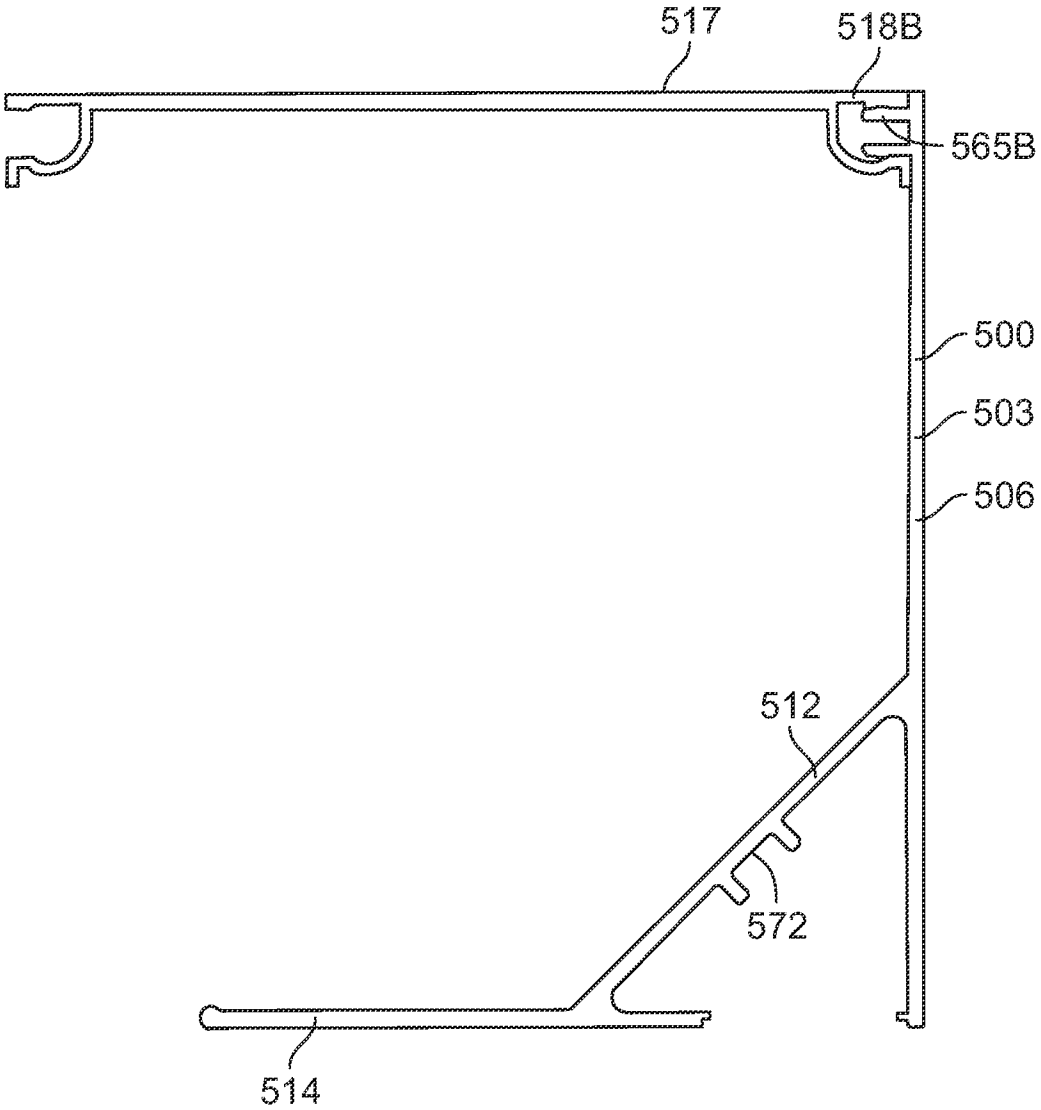
FIG. 10C illustrates yet another diagram of portions of the track component of FIGS. 5A, 5B, and 5C in accordance with some embodiments.
Figure 10D:
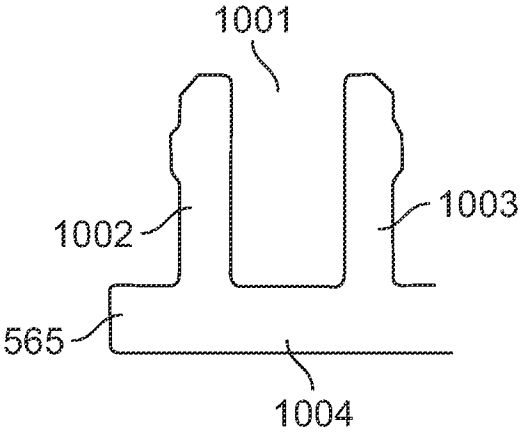
FIG. 10D illustrates a diagram of a male connector component of the track component of FIGS. 5A, 5B, and 5C in accordance with some embodiments.
Figure 10E:
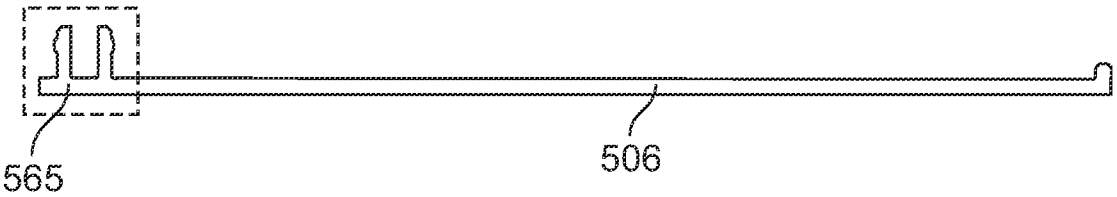
FIG. 10E illustrates a diagram of a side wall that includes the male connector component of FIG. 10D in accordance with some embodiments.
Figure 10F:
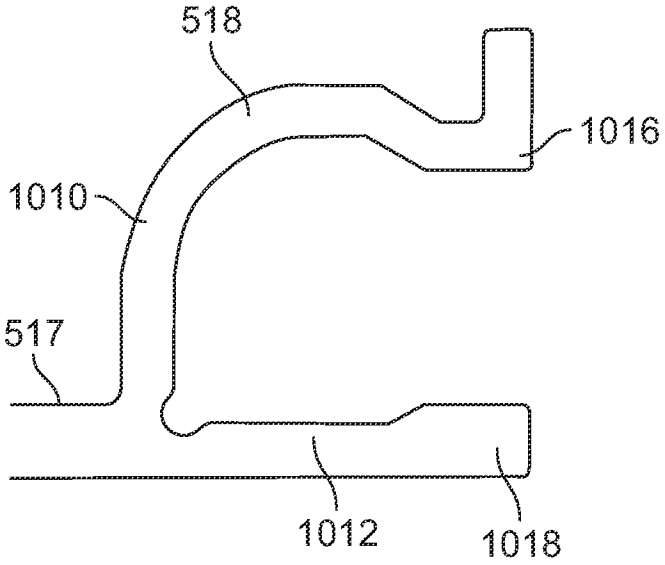
FIG. 10F illustrates a diagram of a female connector component of the track component of FIGS. 5A, 5B, and 5C in accordance with some embodiments.
Figure 10G:
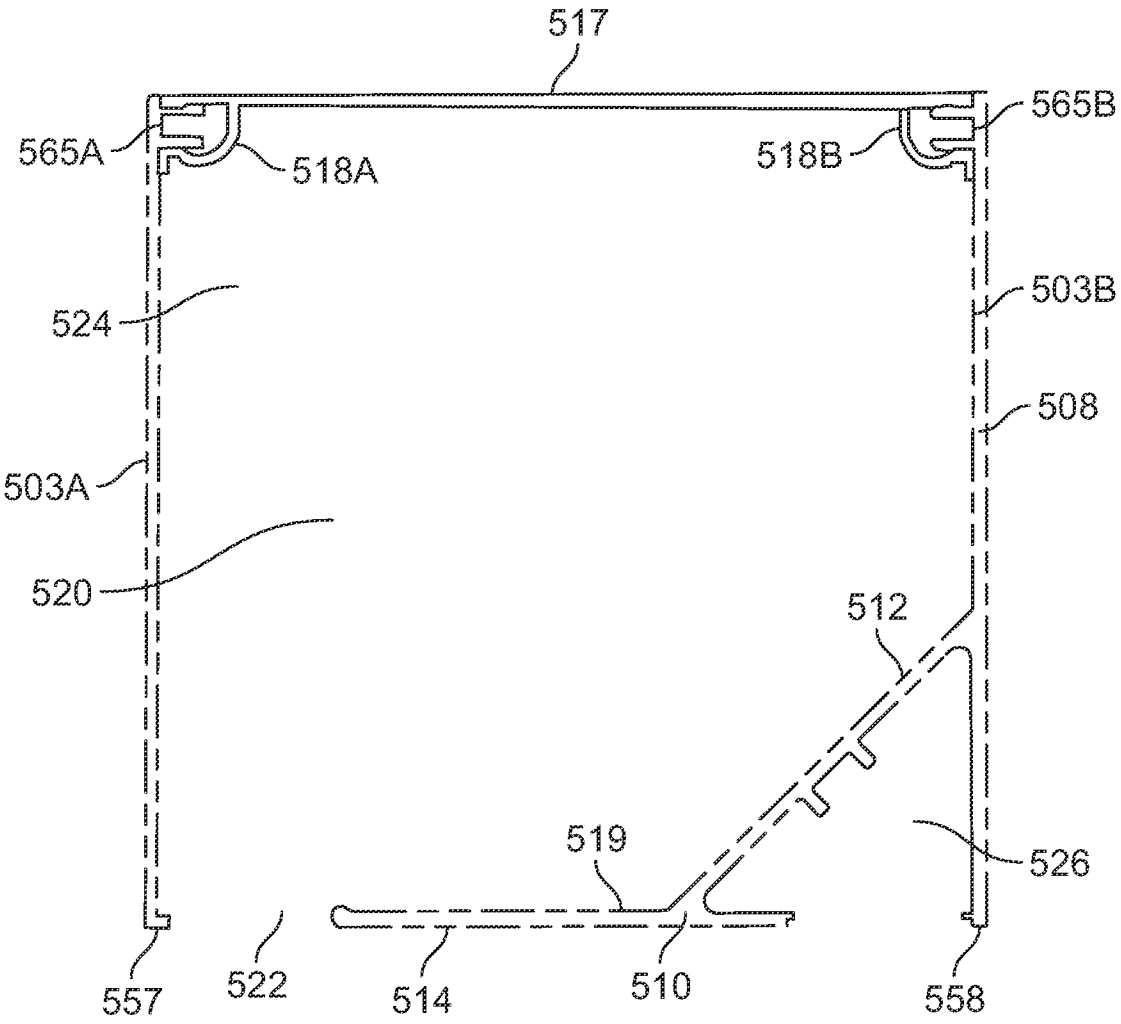
FIG. 10G illustrates the male connector component of FIG. 10D coupled to the female connector component of FIG. 10F in accordance with some embodiments.
Figure 10H:
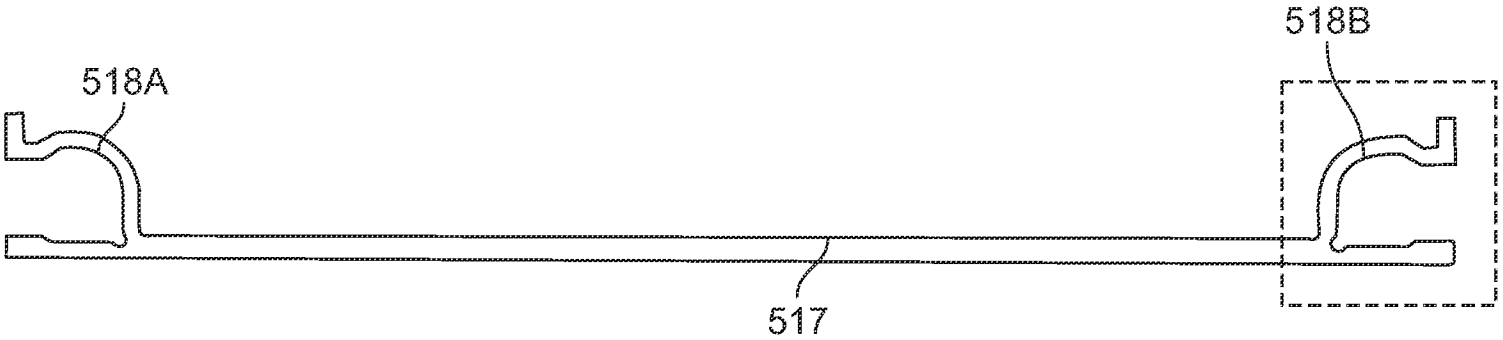
FIG. 10H illustrates a diagram of a back wall that includes the female connector of FIG. 10F in accordance with some embodiments.

FIGS. 10A, 10B, 10C, and 10G illustrate portions of hood component 500. FIG. 10D illustrates a diagram of an end tab 565, such as first end tab 565A or second end tab 565B. End tab 565 includes a channel 1001 defined by a first wall 1002, a second wall 1003, and a third wall 1004. FIG. 10E illustrates a diagram of first side wall 506 with an end tab 565. FIGS. 10F illustrates a diagram of back wall 517 including a back wall channel 518, such as first back wall channel 518A and second back wall channel 518B. Back wall channel 518 is defined by a first wall 1010 that curves radially inward and includes a first wall end 1016, and a second wall 1012 that includes a second wall end 1018. End tab 565 may couple to back wall channel. For example, end tab 565 may "snap" into back wall channel 518. In some examples, a friction fit is formed when end tab 565 is inserted into back wall channel 518. A maximum distance between first wall 1010 and second wall 1012 may, in some examples, be greater than a maximum distance between first wall end 1016 and second wall end 1018. FIG. 10H illustrates a diagram of back wall 517 with first back wall channel 518A and second back wall channel 518B.

Figure 7:
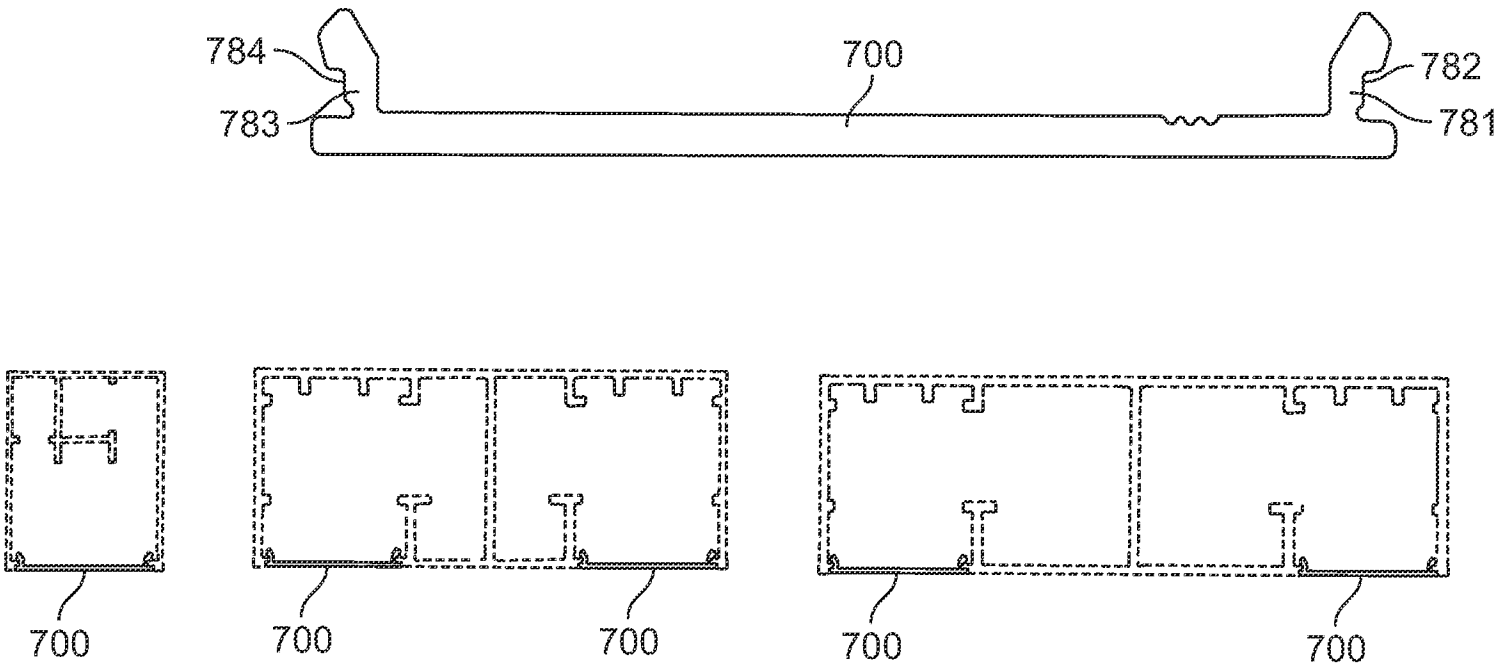
FIG. 7 illustrates a cover component of a multifunctional design housing in accordance with some embodiments.

FIG. 7 illustrates a diagram of an exemplary slot covering 700, such as first slot covering 490 and second slot covering 480 of FIGS. 4A and 4B, first slot covering 390 and second slot covering 380 of FIGS. 3A and 3B, or slot covering 590 of FIGS. 5A, 5B, and 5C. Slot covering 700 includes a first end 783 with a first edge channel 784, and a second end 781 with a second edge channel 782. The arrows indicate distances that may be determined prior to manufacturing. Slot covering 700 may be manufactured such that it will couple to track component 200, track component 300, track component 400, or hood component 500.

In some examples, a multifunctional design housing includes an outer case comprising a back wall, a first side wall extending forward from a first back wall edge and a second side wall extending forward from a second back wall edge. The multifunctional design housing also includes a front opening between a first side wall front edge and a second side wall front edge, where the front opening provides access to an interior volume within the outer case. Further, the multifunctional design housing includes a conduit control arm with a support element spaced forward from the back wall and coupled to the outer case by a spacing element. A back surface of the conduit control arm is in contact with the interior volume.

In some examples, the multifunctional design housing has a uniform lateral cross-section. In some examples, the first back wall edge and the second back wall edge extend longitudinally.

In some examples, the spacing element extends from the back wall. In some examples, the front opening comprises an elongated slot defined by a first front opening edge and a second front opening edge. The multifunctional design housing may further include a first front opening covering adapted to be removably coupled to the first and second front opening edges. In some examples, the conduit control arm is spaced apart from the front opening covering, where the first front opening covering is removably coupled to the first and second front opening edges. In some examples, the first front opening covering is translucent or transparent. In some examples, the conduit control arm is generally L-shaped. In some examples, the conduit control arm is centered behind the elongated slot. In some examples, a front surface of the conduit control arm is in contact with the interior volume.

In some examples, the spacing element extends from the outer case to an intermediate portion of the support element. In some examples, the front opening includes a first slot and a second slot located on opposite sides of the spacing element. The first slot is defined by a first slot inner edge and a first slot outer edge, and the second slot is defined by a second slot inner edge and a second slot outer edge.

In some examples, the multifunctional design housing includes a first slot covering adapted to be removably coupled to the first slot inner edge and the first slot outer edge. In some examples, the multifunctional design housing includes, additionally or alternatively, a second slot covering adapted to be removably coupled to the second slot inner edge and the second slot outer edge. In some examples, the first slot covering, the second slot covering, or both are translucent or transparent.

In some examples, the opposing longitudinal edges of the support element include the first slot inner edge and the second slot inner edge. Additionally or alternatively, the first side wall and the second side wall include the first slot outer edge and the second slot outer edge respectively.

In some examples, the interior volume includes a first interior volume and a second interior volume, which are separated by the spacing element. In some examples, at least one side of the support element includes a conduit retention ridge extending rearwardly. In some examples, heights of the first side wall, the second side wall, and the conduit control arm are the same.

In some examples, a front surface of the conduit control arm is on an exterior of the multifunctional design housing. In some examples, the spacing element extends from the back wall to an intermediate portion of the support element. In some examples, the back wall comprises a first channel aligned with the first slot, a second channel aligned with the second slot, or both. In some examples, the spacing element extends from the back wall to an intermediate portion of the support element.

In some examples, the interior volume includes a first interior volume and a second interior volume, which are separated by the spacing element. In some examples, the second interior volume is less than 40% of a total of the first interior volume and the second interior volume.

In some examples, the front opening includes a first slot and a second slot located on opposite sides of the spacing element. In some examples, the first slot is defined by a first slot inner edge and a first slot outer edge, and the second slot is defined by a second slot inner edge and a second slot outer edge.

In some examples, maximum distances from the back wall are the same for the first side wall, the second side wall, and the conduit control arm. In some examples, a front surface of the conduit control arm is on an exterior of the multifunctional design housing.

In some examples, an ornamental structure includes at least one multifunctional design housing as described herein. For example, the multifunctional design housing may include an outer case comprising a back wall, a first side wall extending forward from a first back wall edge and a second side wall extending forward from a second back wall edge. The multifunctional design housing also includes a front opening between a first side wall front edge and a second side wall front edge, where the front opening provides access to an interior volume within the outer case. Further, the multifunctional design housing includes a conduit control arm with a support element spaced forward from the back wall and coupled to the outer case by a spacing element. A back surface of the conduit control arm may be in contact with the interior volume.

In some examples, the ornamental structure includes lights disposed within the interior volume of the at least one multifunctional design housing, where there is an unobstructed path between the lights and the front opening.

In some examples, the ornamental structure includes a first multifunctional design housing and a second multifunctional design housing arranged parallel to one another, where a guide rod extends through front openings of the first and second multifunctional design housings.

In some examples, the ornamental structure includes a third multifunctional design housing. The third multifunctional design housing may include a front opening aligned with the front openings of the first and second multifunctional design housings. In some examples, the guide rod is part of a retractable screen anchored in the third multifunctional design housing.

The foregoing is provided for purposes of illustrating, explaining, and describing embodiments of these disclosures. Modifications and adaptations to these embodiments will be apparent to those skilled in the art and may be made without departing from the scope or spirit of these disclosures.

What is claimed is:

1. A multifunctional design housing, comprising:

an outer case comprising a back wall, a first side wall extending forward from a first back wall edge and a second side wall extending forward from a second back wall edge;

a front opening between a first side wall front edge and a second side wall front edge, wherein the front opening provides access to an interior volume within the outer case; and a conduit control arm, said conduit control arm comprising a support element and a spacing element, the spacing element coupled to and extending from a portion of an interior surface of the back wall that is off-centered from the front opening and the support element spaced forward from the back wall and centered behind the front opening, wherein a back surface of the support element is in contact with the interior volume, and wherein a front surface of the support element includes at least one light disposed thereon.

2. The multifunctional design housing as claimed in claim 1, wherein the multifunctional design housing has a uniform lateral cross-section.

3. The multifunctional design housing as claimed in claim 1, wherein the first back wall edge and the second back wall edge extend longitudinally.

4. The multifunctional design housing as claimed in claim 1, wherein:

the front opening comprises an elongated slot defined by a first front opening edge and a second front opening edge; and the multifunctional design housing further comprises a front opening covering adapted to be removably coupled to the first and second front opening edges.

5. The multifunctional design housing as claimed in claim 4, wherein the conduit control arm is spaced apart from the front opening covering when the front opening covering is removably coupled to the first and second front opening edges.

6. The multifunctional design housing as claimed in claim 5, wherein the front opening covering is translucent or transparent.

7. The multifunctional design housing as claimed in claim 1, wherein the conduit control arm is generally L-shaped.

8. The multifunctional design housing as claimed in claim 1, wherein a front surface of the conduit control arm is in contact with the interior volume.

9. The multifunctional design housing as claimed in claim 1, wherein the spacing element extends to an intermediate portion of the support element.

10. The multifunctional design housing as claimed in claim 1, wherein at least one side of the support element comprises a conduit retention ridge extending rearwardly toward the interior surface of the back wall.

11. The multifunctional design housing as claimed in claim 1, wherein a front surface of the conduit control arm is on an exterior of the multifunctional design housing.

12. The multifunctional design housing as claimed in claim 1, wherein the interior volume comprises a first interior volume and a second interior volume separated from the first interior volume by the spacing element.

13. The multifunctional design housing as claimed in claim 12, wherein the second interior volume is less than 40% of a total of the first interior volume and the second interior volume.

14. The multifunctional design housing as claimed in claim 1, wherein the front opening comprises a first slot and a second slot located on opposite sides of the spacing element, wherein the first slot is defined by a first slot inner edge and a first slot outer edge, wherein the second slot is defined by a second slot inner edge and a second slot outer edge.

15. The multifunctional design housing as claimed in claim 14, wherein:

opposing longitudinal edges of the support element comprise the first slot inner edge and the second slot inner edge; and the first side wall and the second side wall comprise the first slot outer edge and the second slot outer edge respectively.

16. The multifunctional design housing as claimed in claim 15, further comprising at least one of:

a first slot covering adapted to be removably coupled to the first slot inner edge and the first slot outer edge; and a second slot covering adapted to be removably coupled to the second slot inner edge and the second slot outer edge.

17. An ornamental structure comprising:

at least one multifunctional design housing comprising:

an outer case comprising a back wall, a first side wall extending forward from a first back wall edge and a second side wall extending forward from a second back wall edge;

a front opening between a first side wall front edge and a second side wall front edge, wherein the front opening provides access to an interior volume within the outer case; and a conduit control arm, said conduit control arm comprising a support element and a spacing element, the spacing element coupled to and extending from a portion of an interior surface of the back wall that is off-centered from the front opening and the support element spaced forward from the back wall and centered behind the front opening, wherein a back surface of the support element is in contact with the interior volume; and at least one light disposed within the interior volume and disposed on a front surface of the support element, wherein there is an unobstructed path between the lights and the front opening.

18. The ornamental structure as claimed in claim 17, wherein the at least one multifunctional design housing comprises a first multifunctional design housing and a second multifunctional design housing arranged parallel to one another, wherein a guide rod extends through front openings of the first and second multifunctional design housings.

19. The ornamental structure as claimed in claim 18, further comprising a third multifunctional design housing, wherein the third multifunctional design housing comprises a front opening aligned with the front openings of the first and second multifunctional design housings, and where the guide rod is part of a retractable screen anchored in the third multifunctional design housing.

* * * * *